US012018456B2

(12) United States Patent
Ogawa et al.

(10) Patent No.: US 12,018,456 B2
(45) Date of Patent: Jun. 25, 2024

(54) CONSTRUCTION MACHINE

(71) Applicant: Hitachi Construction Machinery Tierra Co., Ltd., Koka (JP)

(72) Inventors: Yuichi Ogawa, Koka (JP); Takeshi Ishii, Hino-cho (JP); Seiichi Kihara, Koka (JP); Kiwamu Takahashi, Moriyama (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 355 days.

(21) Appl. No.: 17/632,382

(22) PCT Filed: Mar. 26, 2020

(86) PCT No.: PCT/JP2020/013851
§ 371 (c)(1),
(2) Date: Feb. 2, 2022

(87) PCT Pub. No.: WO2021/192187
PCT Pub. Date: Sep. 30, 2021

(65) Prior Publication Data
US 2022/0290403 A1 Sep. 15, 2022

(51) Int. Cl.
*E02F 9/20* (2006.01)
*E02F 3/32* (2006.01)

(52) U.S. Cl.
CPC ..... *E02F 9/2025* (2013.01); *E02F 3/325* (2013.01); *E02F 9/2066* (2013.01); *E02F 9/207* (2013.01)

(58) Field of Classification Search
CPC ..... E02F 9/2025; E02F 9/2066; E02F 9/207
See application file for complete search history.

(56) References Cited

U.S. PATENT DOCUMENTS

2018/0032203 A1* 2/2018 Sepulveda ..... G06F 3/0412
2020/0190773 A1* 6/2020 Hoshino ..... E02F 9/2296

FOREIGN PATENT DOCUMENTS

EP 2 463 720 A2 6/2012
JP 2012-123248 A 6/2012
WO WO 2018/179313 A1 10/2018

OTHER PUBLICATIONS

International Search Report (PCT/ISA/210) issued in PCT Application No. PCT/JP2020/013851 dated May 26, 2020 with English translation (five (5) pages).

(Continued)

*Primary Examiner* — Khoi H Tran
*Assistant Examiner* — Aaron G Cain
(74) *Attorney, Agent, or Firm* — Crowell & Moring LLP

(57) ABSTRACT

It is made possible to perform power reduction control during non-operation of control levers, and suppress power consumption of a power source when a control lever is moved by an erroneous operation, and thus reduce energy consumption. Accordingly, a controller 50 performs the power reduction control when a non-operation time exceeds a set time after a transition is made from a state in which at least one control lever is operated to a non-operation state in which none of the control levers is operated, and the controller 50 cancels the power reduction control when at least one control lever is operated in a state in which the power reduction control is performed. In addition, the set time is set as a first set time Tth1 when an operation time until at least one of levers 14 and 34 makes a transition to the non-operation state is longer than a monitoring time Tth0, and the set time is set as a second set time Tth2 shorter than the first set time Tth1 when the operation time until the at least one control lever makes a transition to the non-operation state is shorter than the monitoring time Tth0.

7 Claims, 30 Drawing Sheets

(56) References Cited

OTHER PUBLICATIONS

Japanese-language Written Opinion (PCT/ISA/237) issued in PCT Application No. PCT/JP2020/013851 dated May 26, 2020 (three (3) pages).
International Preliminary Report on Patentability (PCT/IB/338 & PCT/IB/373) issued in PCT Application No. PCT/JP2020/013851 dated Oct. 6, 2022, including English translation of document C2 (Japanese-language Written Opinion (PCT/ISA/237), filed on Feb. 2, 2022) (five (5) pages).

* cited by examiner $\Delta t$ : SAMPLING TIME

CONSTRUCTION MACHINE

TECHNICAL FIELD

The present invention relates to a construction machine such as a hydraulic excavator, and particularly to a construction machine that performs power reduction control of reducing power output by a power source during non-operation of control levers.

BACKGROUND ART

Patent Document 1, for example, describes a technology of performing, in a construction machine, power reduction control referred to as auto idle control, which reduces power output by an engine as a power source by reducing the rotation speed of the engine during non-operation of control levers in order to reduce an amount of fuel consumed by the engine and thereby save energy consumption.

PRIOR ART DOCUMENT

Patent Document

Patent Document 1: WO2018/179313

SUMMARY OF THE INVENTION

Problems to be Solved by the Invention

The construction machine that performs the power reduction control (auto idle control) of reducing the power output by the engine as a power source during non-operation of the control levers as described in Patent Document 1 is generally allowed to return to a normal power state by canceling the power reduction control when a control lever is operated. However, in the case where the power reduction control is performed in such a manner, when a hand erroneously hits a control lever, for example, a return to the normal power state is made by canceling the control although there is no intention of canceling the power reduction control. That is, although there should be no need to return the engine from a state in which the power is reduced to the normal state, the power reduction control of the engine is canceled. Thus, an effect of saving the energy consumption of the engine is reduced.

The present invention has been made in view of the above-described problems. It is an object of the present invention to provide a construction machine that can perform power reduction control during non-operation of control levers, and suppress power consumption of a power source and thus reduce energy consumption of the power source when a control lever is moved by an erroneous operation.

Means for Solving the Problems

In order to solve such problems, according to the present invention, there is provided a construction machine including: a power source; a plurality of actuators that operate by receiving power from the power source; a plurality of control levers that instruct amounts of the power to be distributed to the plurality of actuators; a plurality of operation state sensors that detect operation states of the plurality of control levers; and a controller that controls the power output by the power source, the controller being configured to perform power reduction control of the power source on a basis of the operation states of the plurality of control levers detected by the plurality of operation state sensors when a non-operation time of the plurality of control levers exceeds a set time after a transition is made from a state in which at least one of the plurality of control levers is operated to a non-operation state in which none of the plurality of control levers is operated, and to cancel the power reduction control when at least one of the plurality of control levers is operated in a state in which the power reduction control is performed. Further, in the construction machine, the controller is configured to set the set time as a first set time when an operation time until the at least one control lever makes a transition to the non-operation state is longer than a monitoring time set in advance, and set the set time as a second set time shorter than the first set time when the operation time until the at least one control lever makes a transition to the non-operation state is shorter than the monitoring time set in advance.

In this way, the controller is configured to set the set time as the second set time shorter than the first set time when the operation time until the at least one control lever makes a transition to the non-operation state is shorter than the monitoring time set in advance. Consequently, when a control lever is moved by an erroneous operation, the power reduction control is temporarily canceled to return to a normal power state, but a return is thereafter made to a power reduction state in a short time. It is therefore possible to suppress power consumption of the power source and thus reduce energy consumption of the power source when a control lever is moved by an erroneous operation.

Advantages of the Invention

According to the present invention, it is possible to perform power reduction control during non-operation of the control levers, and suppress power consumption of the power source when a control lever is moved by an erroneous operation, and thus reduce energy consumption of the power source.

MODES FOR CARRYING OUT THE INVENTION

Embodiments of the present invention will hereinafter be described according to the drawings.

First Embodiment

A first embodiment of the present invention will be described with reference to FIGS. 1 to 14.

~Configuration~

(Hydraulic Excavator)

Description will first be made of a hydraulic excavator as a typical example of a construction machine in the first embodiment of the present invention.

Figure 1:
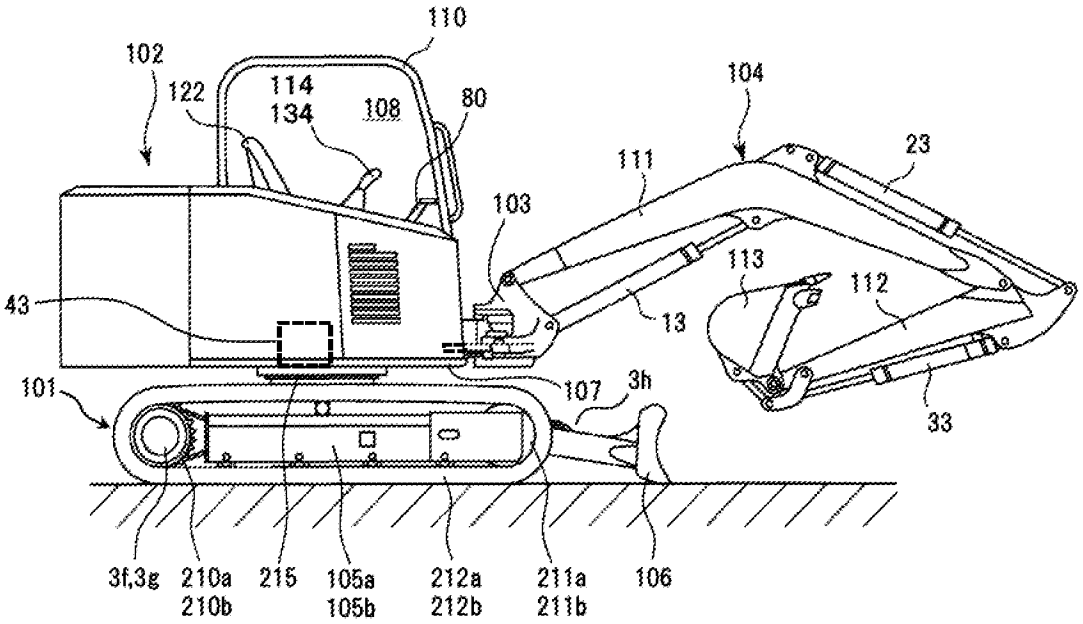
FIG. 1 is a diagram showing an external appearance of a construction machine (hydraulic excavator) in a first embodiment of the present invention.

FIG. 1 is a diagram showing an external appearance of a hydraulic excavator in the present embodiment.

The hydraulic excavator includes a lower track structure 101, an upper swing structure 102 swingably mounted on the lower track structure, and a swing type front work implement 104 attached to a front portion of the upper swing structure so as to be rotatable in an upward-downward direction. The front work implement 104 includes a boom 111, an arm 112, and a bucket 113. The upper swing structure 102 and the lower track structure 101 are rotatably connected to each other by a swing wheel 215. The upper swing structure 102 is swingable with respect to the lower track structure 101 by rotation of a swing motor 43. A swing post 103 is attached to a front portion of the upper swing structure 102. The front work implement 104 is attached to the swing post 103 so as to be vertically movable. The swing post 103 is rotatable with respect to the upper swing structure 102 in a horizontal direction by expansion and contraction of a swing cylinder (not shown). The boom 111, the arm 112, and the bucket 113 of the front work implement 104 are rotatable in the upward-downward direction by expansion and contraction of a boom cylinder 13, an arm cylinder 23, and a bucket cylinder 33 as a first front implement actuator, a second front implement actuator, and a third front implement actuator. Attached to a central frame of the lower track structure 101 are a right and a left track device 105*a* and 105*b* and a blade 106 that moves up and down according to expansion and contraction of a blade cylinder 3*h*. The right and left track devices 105*a* and 105*b* include driving wheels 210*a* and 210*b*, idlers 211*a* and 211*b*, and crawlers 212*a* and 212*b*, respectively. The right and left track devices 105*a* and 105*b* travel by transmitting rotation of a right and a left travelling motor 3*f* and 3*g* to the driving wheels 210*a* and 210*b*, and thereby driving the crawlers 212*a* and 212*b*.

A cabin 110 in which a cab 108 is formed is installed on the upper swing structure 102. The cab 108 is provided with a cab seat 122 and a right and a left control lever device 114 and 134 that instruct driving of the boom cylinder 13, the arm cylinder 23, the bucket cylinder 33, and the swing motor 43. In addition, similar control lever devices are provided also for the travelling motors 3*f* and 3*g*, the blade cylinder 3*h*, and the swing cylinder not shown. These control lever devices are also provided in the cab 108.

(Driving System)

Figure 2:
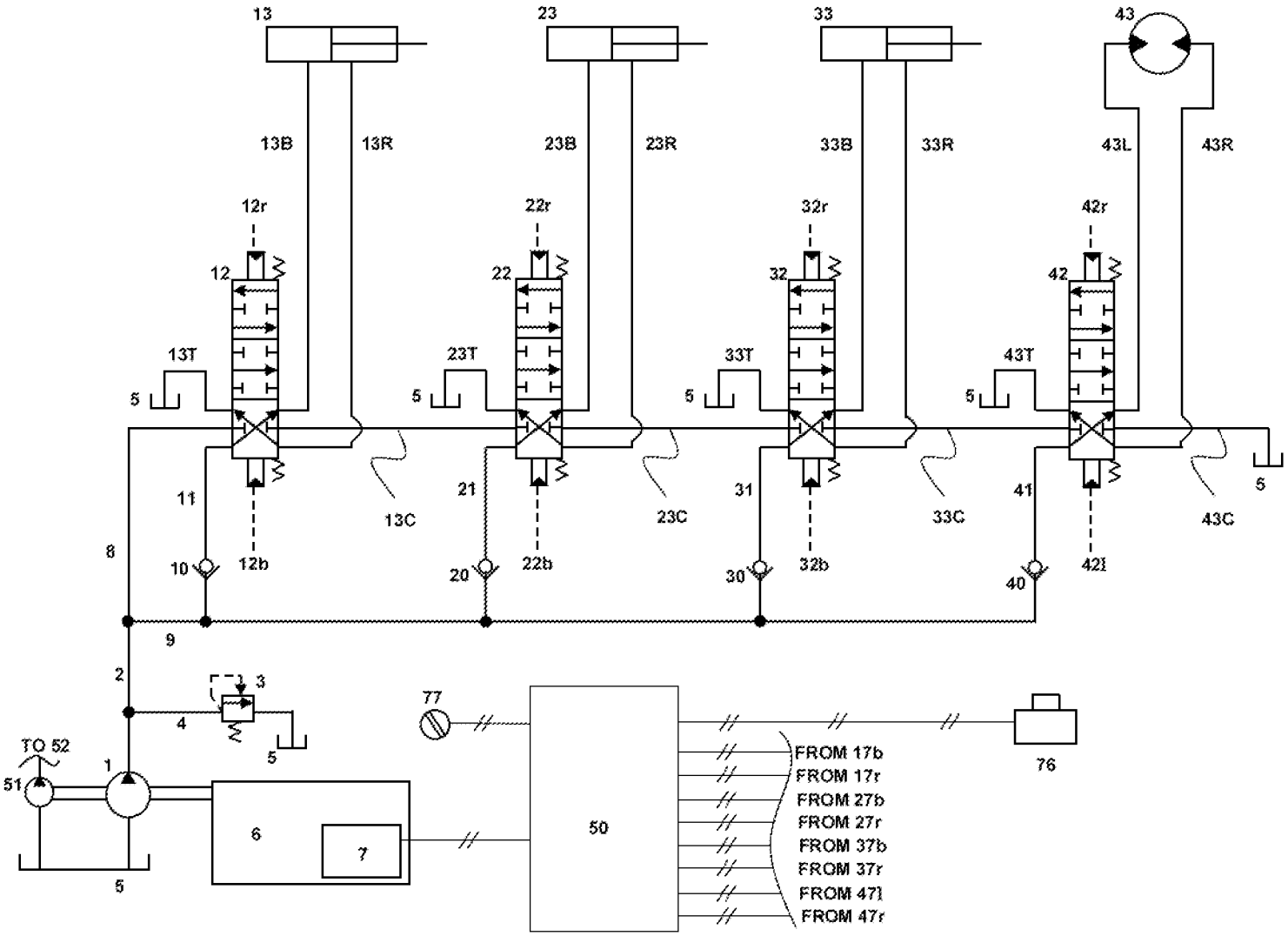
FIG. 2 is a diagram showing a configuration of a driving system in the first embodiment.

Description will next be made of a driving system included in the construction machine (hydraulic excavator) according to the present embodiment. FIG. 2 is a diagram showing a configuration of the driving system according to the present embodiment.

In FIG. 2, the driving system includes an engine 6 (diesel engine) as well as a main hydraulic pump 1 and a pilot pump 51. The hydraulic pump 1 and the pilot pump 51 are driven by the engine 6. The hydraulic pump 1 is connected to a line 2. A relief valve 3 is attached to the line 2 via a relief line 4. The downstream side of the relief valve 3 is connected to a tank 5. A line 8 and a line 9 are connected downstream of the line 2. Lines 11, 21, 31, and 41 are connected in parallel to the line 9. Check valves 10, 20, 30, and 40 are arranged on the lines 11, 21, 31, and 41, respectively.

A directional control valve 12 is connected downstream of the line 8 and the line 11. The directional control valve 12 is also connected with a bottom line 13B connected to a bottom side chamber of the boom cylinder 13, a rod line 13R connected to a rod side chamber of the boom cylinder 13, a tank line 13T connected to the tank 5, and a center bypass line 13C.

The directional control valve 12 is driven by the pressure of a pilot line 12*b* and the pressure of a pilot line 12*r*. When the pressures of both pilot lines are low, the directional control valve 12 is at a neutral position so that the line 8 is connected to the center bypass line 13C and the other lines are interrupted. When the pressure of the pilot line 12*b* is high, the directional control valve 12 is switched upward in the figure so that the line 11 is connected to the bottom line 13B, the tank line 13T is connected to the rod line 13R, and the line 8 and the center bypass line 13C are interrupted. When the pressure of the pilot line 12*r* is high, the directional control valve 12 is switched downward in the figure so that the line 11 is connected to the rod line 13R, the tank line 13T is connected to the bottom line 13B, and the line 8 and the center bypass line 13C are interrupted.

A directional control valve 22 is connected downstream of the line 13C and the line 21. The directional control valve 22 is also connected with a bottom line 23B connected to a bottom side chamber of the arm cylinder 23, a rod line 23R connected to a rod side chamber of the arm cylinder 23, a tank line 23T connected to the tank 5, and a center bypass line 23C.

The directional control valve 22 is driven by the pressure of a pilot line 22*b* and the pressure of a pilot line 22*r*. When the pressures of both pilot lines are low, the directional control valve 22 is at a neutral position so that the center bypass line 13C is connected to the center bypass line 23C and the other lines are interrupted. When the pressure of the pilot line 22*b* is high, the directional control valve 22 is switched upward in the figure so that the line 21 is connected to the bottom line 23B, the tank line 23T is connected to the rod line 23R, and the center bypass line 13C and the center bypass line 23C are interrupted. When the pressure of the pilot line 22*r* is high, the directional control valve 22 is switched downward in the figure so that the line 21 is connected to the rod line 23R, the tank line 23T is connected to the bottom line 23B, and the center bypass line 13C and the center bypass line 23C are interrupted.

A directional control valve 32 is connected downstream of the line 23C and the line 31. The directional control valve 32 is also connected with a bottom line 33B connected to a bottom side chamber of the bucket cylinder 33, a rod line 33R connected to a rod side chamber of the bucket cylinder 33, a tank line 33T connected to the tank 5, and a center bypass line 33C.

The directional control valve 32 is driven by the pressure of a pilot line 32*b* and the pressure of a pilot line 32*r*. When the pressures of both of the pilot lines are low, the directional control valve 32 is at a neutral position so that the center bypass line 23C is connected to the center bypass line 33C and the other lines are interrupted. When the pressure of the pilot line 32*b* is high, the directional control valve 32 is switched upward in the figure so that the line 31 is connected to the bottom line 33B, the tank line 33T is connected to the rod line 33R, and the center bypass line 23C and the center bypass line 33C are interrupted. When the pressure of the pilot line 32*r* is high, the directional control valve 32 is switched downward in the figure so that the line 31 is connected to the rod line 33R, the tank line 33T is connected to the bottom line 33B, and the center bypass line 23C and the center bypass line 33C are interrupted.

A directional control valve 42 is connected downstream of the line 33C and the line 41. The directional control valve 42 is also connected with a left rotation line 43L connected to a left rotation side chamber of the swing motor 43, a right rotation line 43R connected to a right rotation side chamber of the swing motor 43, a tank line 43T connected to the tank 5, and a center bypass line 43C. The center bypass line 43C is connected to the tank 5.

The directional control valve 42 is driven by the pressure of a pilot line 42*l* and the pressure of a pilot line 42*r*. When the pressures of both of the pilot lines are low, the directional control valve 42 is at a neutral position so that the center bypass line 33C is connected to the center bypass line 43C and the other lines are interrupted. When the pressure of the pilot line 42*l* is high, the directional control valve 42 is switched upward in the figure so that the line 41 is connected to the left rotation line 43L, the tank line 43T is connected to the right rotation line 43R, and the center bypass line 33C and the center bypass line 43C are interrupted. When the pressure of the pilot line 42*r* is high, the directional control valve 42 is switched downward in the figure so that the line 41 is connected to the right rotation line 43R, the tank line 43T is connected to the left rotation line 43L, and the center bypass line 33C and the center bypass line 43C are interrupted.

The pilot pump 51 is connected to a pilot line 52. The downstream of the pilot line 52 will be described later with reference to FIG. 4.

Incidentally, though not shown, the hydraulic drive system has similar directional control valves provided also for the travelling motors 3*f* and 3*g* and the blade cylinder 3*h* shown in FIG. 1 and the swing cylinder not shown in the figure so that the connection and interruption of lines can be performed.

Here, the engine 6 and the hydraulic pump 1 constitute a power source, and the boom cylinder 13, the arm cylinder 23, the bucket cylinder 33, the swing motor 43, the travelling motors 3*f* and 3*g*, the blade cylinder 3*h*, and the swing cylinder not shown constitute a plurality of actuators that are actuated by receiving power from the power source. A plurality of control levers of the control lever devices 114 and 134 shown in FIG. 1 and the other control lever devices not shown each instruct amounts of power to be distributed to the plurality of actuators. The directional control valves 12, 22, 32, and 42 and the other directional control valves not shown distribute power to the plurality of actuators on the basis of the instructions of the plurality of control levers.

(Control Lever Devices)

Figure 3:
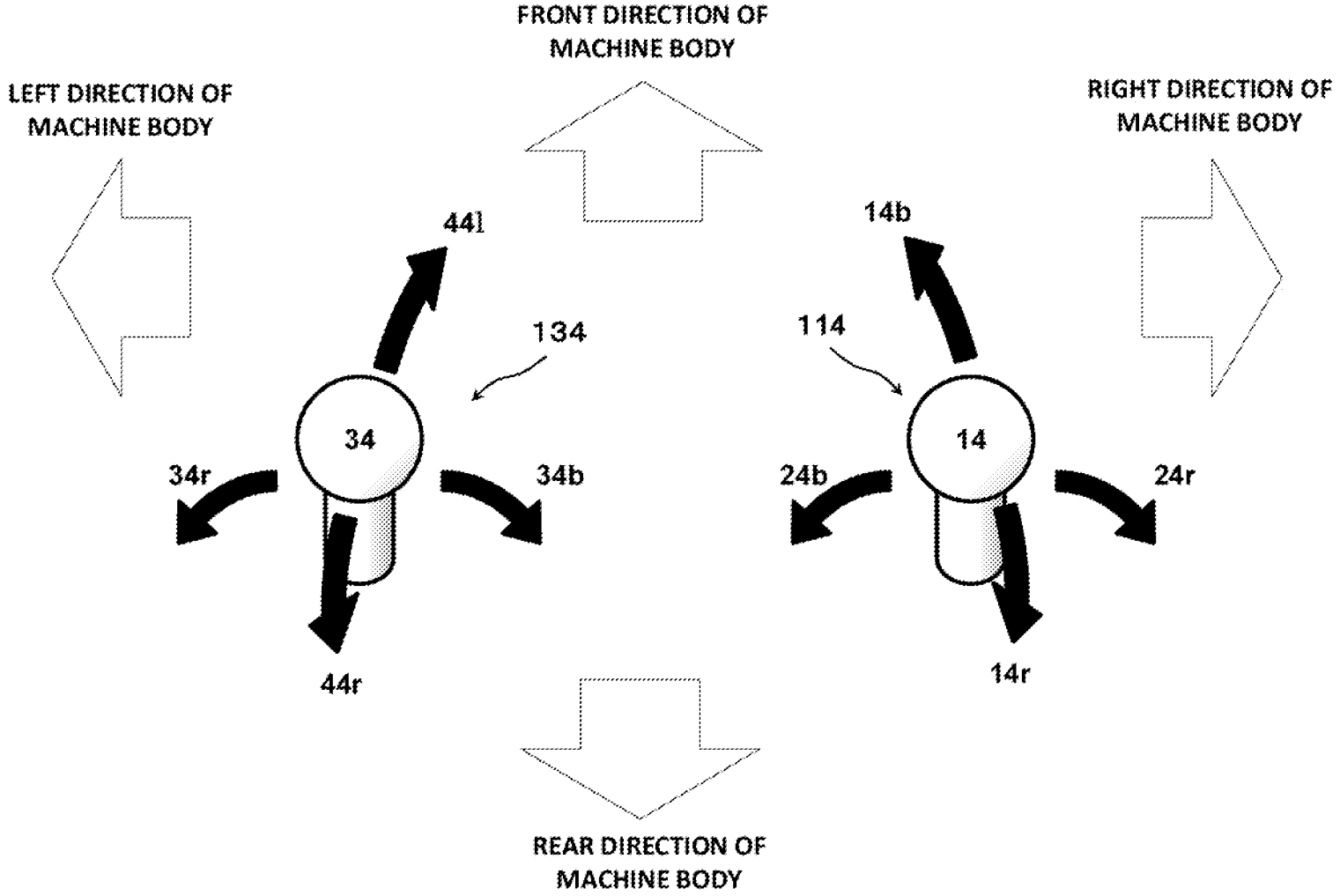
FIG. 3 is a diagram of assistance in explaining movable directions of control levers of control lever devices in the first embodiment and definitions of the movable directions.

Configurations of control lever devices will next be described with reference to FIG. 3 and FIG. 4. FIG. 3 is a diagram of assistance in explaining movable directions of the control levers of the control lever devices 114 and 134 in the first embodiment and definitions of the movable directions.

As described with reference to FIG. 1, the right and left control lever devices 114 and 134 are installed in the cab 108 of the hydraulic excavator. An operator operates a control lever 14 (first control lever) of the control lever device 114 with a right hand, and operates a control lever 34 (second control lever) of the control lever device 134 with a left hand. The control lever devices 114 and 134 each allow two actuators to be operated by one control lever 14 or 34. The control levers 14 and 34 can each be operated from a neutral position. Operations of the control lever 14 in a forward direction 14*b* and a rearward direction 14*r* correspond to operations of boom lowering and boom raising of the boom cylinder 13. Operations of the control lever 14 in a right direction 24*r* and a left direction 24*b* correspond to operations of bucket dumping and bucket crowding of the bucket cylinder 33. Operations of the control lever 34 in a right direction 34*b* and a left direction 34*r* correspond to operations of arm crowding and arm dumping of the arm cylinder 23. Operations of the control lever 34 in a forward direction 44*l* and a rearward direction 44*r* correspond to operations of right swinging and left swinging of the swing motor 43.

Incidentally, the forward direction, the rearward direction, the right direction, and the left direction in the present specification refer to a front direction, a rear direction, a right direction, and a left direction of the upper swing structure 102 as a machine body.

Thus, the control levers 14 and 34 of the control lever devices 114 and 134 can be operated in the plurality of directions from the neutral position, and operate different actuators among the plurality of actuators (the boom cylinder 13, the arm cylinder 23, the bucket cylinder 33, and the swing motor 43).

Figure 4:
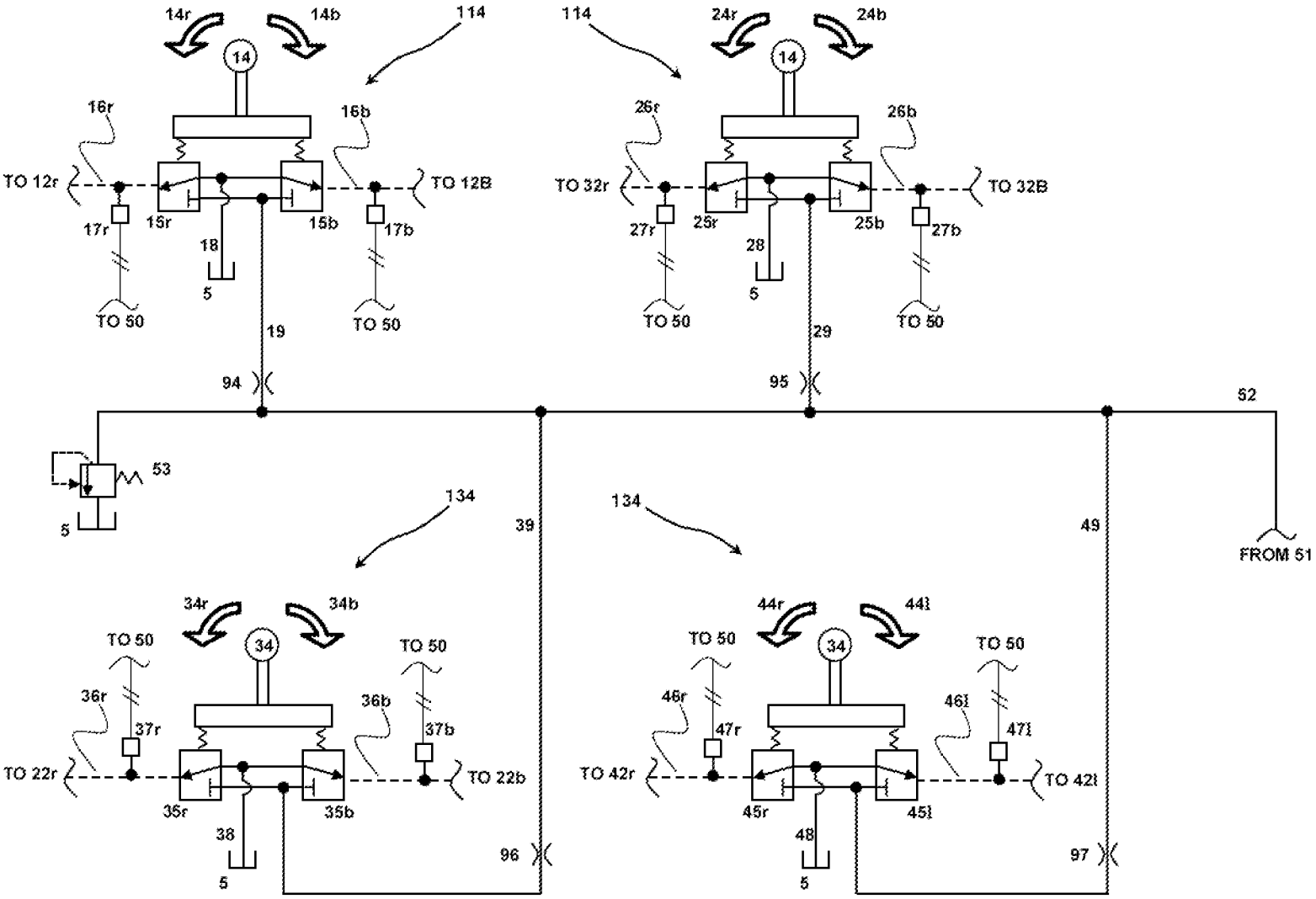
FIG. 4 is a diagram showing a configuration of an operating system of the driving system in the first embodiment.

FIG. 4 is a diagram showing a configuration of an operating system of the driving system.

In FIG. 4, the control lever devices 114 and 134 are of a hydraulic pilot type, the control lever device 114 includes pilot valves 15*b* and 15*r* for the boom and pilot valves 25*b* and 25*r* for the bucket, the pilot valves 15*b* and 15*r* and the pilot valves 25*b* and 25*r* driven by the control lever 14 (first lever), and the control lever device 134 includes pilot valves 35*b* and 35*r* for the arm and pilot valves 45*l* and 45*r* for swinging, the pilot valves 35*b* and 35*r* and the pilot valves 45*l* and 45*r* driven by the control lever 34 (second lever). In the following description, the control levers may be referred to simply as "levers."

Lines 19, 29, 39, and 49 and a relief valve 53 are connected in parallel with each other downstream of the pilot line 52. The tank 5 is connected downstream of the relief valve 53. The lines 19, 29, 39, and 49 are provided with restricting sections 94, 95, 96, and 97, respectively.

The pilot valve 15*b* of the control lever device 114 is connected to the line 19, and is connected to a line 18 and a line 16*b*. The line 16*b* is connected to the pilot line 12*b* (see FIG. 2). A pressure sensor 17*b* is attached onto the line 16*b*. The line 18 is connected to the tank 5.

When the lever 14 is at the neutral position, the pilot valve 15*b* connects the line 18 and the line 16*b* to each other, and interrupts the line 19. When the lever 14 is operated in the forward direction 14*b*, the pilot valve 15*b* connects the line 19 and the line 16*b* to each other, and interrupts the line 18. At this time, a pressure (operation pressure) corresponding to an operation amount of the lever 14 is generated in the line 16*b*.

The pressure sensor 17*b* measures the pressure of the line 16*b*, and transmits a signal to a controller 50 electrically connected to the pressure sensor 17*b*.

The pilot valve 15*r* of the control lever device 114 is connected to the line 19, and is connected to the line 18 and a line 16*r*. The line 16*r* is connected to the pilot line 12*r* (see FIG. 2). A pressure sensor 17*r* is attached onto the line 16*r*. The line 18 is connected to the tank 5.

When the lever 14 is at the neutral position, the pilot valve 15*r* connects the line 18 and the line 16*r* to each other, and interrupts the line 19. When the lever 14 is operated in the rearward direction 14*r*, the pilot valve 15*r* connects the line 19 and the line 16*r* to each other, and interrupts the line 18. At this time, a pressure (operation pressure) corresponding to an operation amount of the lever 14 is generated in the line 16*r*.

The pressure sensor 17*r* measures the pressure of the line 16*r*, and transmits a signal to the controller 50 electrically connected to the pressure sensor 17*r*.

The pilot valve 25*b* of the control lever device 114 is connected to the line 29, and is connected to a line 28 and a line 26*b*. The line 26*b* is connected to the pilot line 32*b* (see FIG. 2). A pressure sensor 27*b* is attached onto the line 26*b*. The line 28 is connected to the tank 5.

When the lever 14 is at the neutral position, the pilot valve 25*b* connects the line 28 and the line 26*b* to each other, and interrupts the line 29. When the lever 14 is operated in the left direction 24*b*, the pilot valve 25*b* connects the line 29 and the line 26*b* to each other, and interrupts the line 28. At this time, a pressure (operation pressure) corresponding to an operation amount of the lever 14 is generated in the line 26*b*.

The pressure sensor 27*b* measures the pressure of the line 26*b*, and transmits a signal to the controller 50 electrically connected to the pressure sensor 27*b*.

The pilot valve 25*r* of the control lever device 114 is connected to the line 29, and is connected to the line 28 and a line 26*r*. The line 26*r* is connected to the pilot line 32*r* (see FIG. 2). A pressure sensor 27*r* is attached onto the line 26*r*. The line 28 is connected to the tank 5.

When the lever 14 is at the neutral position, the pilot valve 25*r* connects the line 28 and the line 26*r* to each other, and interrupts the line 29. When the lever 14 is operated in the right direction 24*r*, the pilot valve 25*r* connects the line 29 and the line 26*r* to each other, and interrupts the line 28. At this time, a pressure (operation pressure) corresponding to an operation amount of the lever 14 is generated in the line 26*r*.

The pressure sensor 27*r* measures the pressure of the line 26*r*, and transmits a signal to the controller 50 electrically connected to the pressure sensor 27*r*.

The pilot valve 35*b* of the control lever device 134 is connected to the line 39, and is connected to a line 38 and a line 36*b*. The line 36*b* is connected to the pilot line 22*b* (see FIG. 2). A pressure sensor 37*b* is attached onto the line 36*b*. The line 38 is connected to the tank 5.

When the lever 34 is at the neutral position, the pilot valve 35*b* connects the line 38 and the line 36*b* to each other, and interrupts the line 39. When the lever 34 is operated in the right direction 34*b*, the pilot valve 35*b* connects the line 39 and the line 36*b* to each other, and interrupts the line 38. At this time, a pressure (operation pressure) corresponding to an operation amount of the lever 34 is generated in the line 36*b*.

The pressure sensor 37*b* measures the pressure of the line 36*b*, and transmits a signal to the controller 50 electrically connected to the pressure sensor 37*b*.

The pilot valve 35*r* of the control lever device 134 is connected to the line 39, and is connected to the line 38 and a line 36*r*. The line 36*r* is connected to the pilot line 22*r* (see FIG. 2). A pressure sensor 37*r* is attached onto the line 36*r*. The line 38 is connected to the tank 5.

When the lever 34 is at the neutral position, the pilot valve 35*r* connects the line 38 and the line 36*r* to each other, and interrupts the line 39. When the lever 34 is operated in the left direction 34*r*, the pilot valve 35*r* connects the line 39 and the line 36*r* to each other, and interrupts the line 38. At this time, a pressure (operation pressure) corresponding to an operation amount of the lever 34 is generated in the line 36*r*.

The pressure sensor 37*r* measures the pressure of the line 36*r*, and transmits a signal to the controller 50 electrically connected to the pressure sensor 37*r*.

The pilot valve 45*l* of the control lever device 134 is connected to the line 49, and is connected to a line 48 and a line 46*l*. The line 46*l* is connected to the pilot line 42*l* (see FIG. 2). A pressure sensor 47*l* is attached onto the line 46*l*. The line 48 is connected to the tank 5.

When the lever 34 is at the neutral position, the pilot valve 45*l* connects the line 48 and the line 46*l* to each other, and interrupts the line 49. When the lever 34 is operated in the forward direction 44*l*, the pilot valve 45*l* connects the line 49 and the line 46*l* to each other, and interrupts the line 48. At this time, a pressure (operation pressure) corresponding to an operation amount of the lever 34 is generated in the line 46*l*.

The pressure sensor 47*l* measures the pressure of the line 46*l*, and transmits a signal to the controller 50 electrically connected to the pressure sensor 47*l*.

The pilot valve 45*r* of the control lever device 134 is connected to the line 49, and is connected to the line 48 and a line 46*r*. The line 46*r* is connected to the pilot line 42*r* (see FIG. 2). A pressure sensor 47*r* is attached onto the line 46*r*. The line 48 is connected to the tank 5.

When the lever 34 is at the neutral position, the pilot valve 45*r* connects the line 48 and the line 46*r* to each other, and interrupts the line 49. When the lever 34 is operated in the rearward direction 44*r*, the pilot valve 45*r* connects the line 49 and the line 46*r* to each other, and interrupts the line 48. At this time, a pressure (operation pressure) corresponding to an operation amount of the lever 34 is generated in the line 46*r*.

The pressure sensor 47*r* measures the pressure of the line 46*r*, and transmits a signal to the controller 50 electrically connected to the pressure sensor 47*r*.

The pressure sensors 17*b*, 17*r*, 27*b*, 27*r*, 37*b*, 37*r*, 47*l*, and 47*r* constitute a plurality of operation state sensors that detect operation states of the control lever devices 114 and 134. In addition, the pressure sensors 17*b* and 17*r* constitute a first operation state sensor that detects the operation state in a forward-rearward direction of the control lever 14. The pressure sensors 27*b* and 27*r* constitute a second operation state sensor that detects the operation state in a right-left direction of the control lever 14. The pressure sensors 37*b* and 37*r* constitute a third operation state sensor that detects the operation state in the right-left direction of the control lever 34. The pressure sensors 47*l* and 47*r* constitute a fourth operation state sensor that detects the operation state in the forward-rearward direction of the control lever 34.

Incidentally, though not shown, the operating system has similar pressure sensors (operation state sensors) provided also for the control lever devices other than the control lever devices 114 and 134, and power reduction control to be described later can be performed on the basis of the operation states of the control levers of these control lever devices.

(Continuation for Driving System)

Returning to FIG. 2, the driving system according to the present embodiment further include the controller 50, a switch 76, and a target rotation speed indicating device 77.

The controller 50 is electrically connected to the pressure sensors 17*b*, 17*r*, 27*b*, 27*r*, 37*b*, 37*r*, 47*l*, and 47*r*, the switch 76, and the target rotation speed indicating device 77. The controller 50 receives signals of measured pressures from the pressure sensors 17*b* to 47*r*, a signal from the switch 76, and a signal from the target rotation speed indicating device 77, computes a target rotation speed for controlling the engine 6 on the basis of these signals, and transmits a command signal of the target rotation speed to a rotation speed controller 7 of the engine 6, which is electrically connected to the controller 50. The rotation speed controller 7 controls the engine 6 so as to achieve the target rotation speed.

The switch 76 is a switch that selects whether to set a power reduction control mode by transmitting an ON or OFF signal to the controller 50. When the signal of the switch 76 is OFF, the power reduction control mode is canceled, and driving power of the engine 6 is not reduced even if all of the control levers are in a non-operation state.

(Controller 50)

Figure 5:
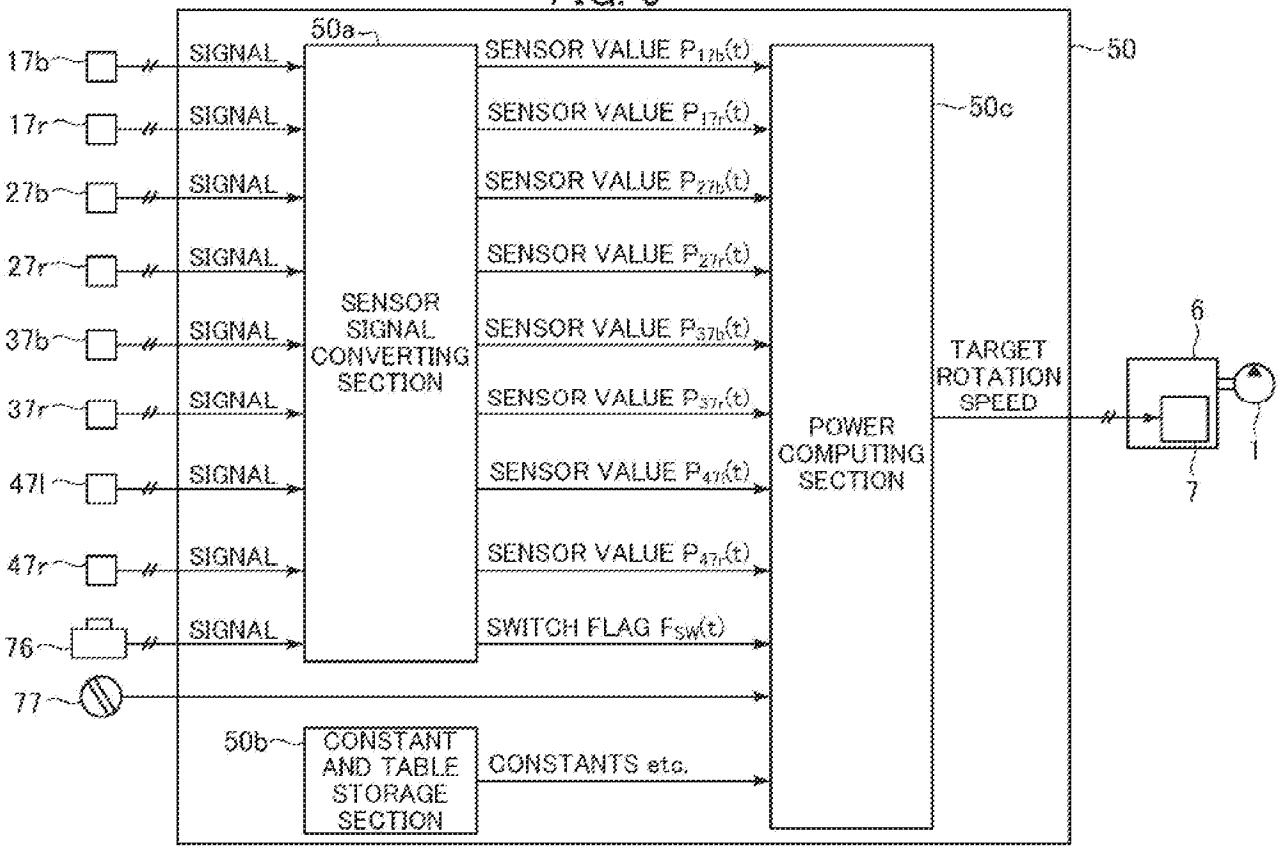
FIG. 5 is a block diagram showing functions of a controller in the first embodiment.

Functions of the controller 50 in the first embodiment will next be described. FIG. 5 is a block diagram showing functions of the controller 50.

A basic concept of control performed by the controller 50 will first be described.

The controller 50 performs power reduction control of the engine 6 and the hydraulic pump 1 (power source) on the basis of the operation states of the control levers 14 and 34 (plurality of control levers) detected by the pressure sensors 17*b*, 17*r*, 27*b*, 27*r*, 37*b*, 37*r*, 47*l*, and 47*r* (plurality of operation state sensors) when a non-operation time of the control levers 14 and 34 exceeds a set time after a transition is made from a state in which at least one of the control levers 14 and 34 is operated to a non-operation state in which none of the control levers 14 and 34 is operated. The controller 50 cancels the power reduction control when at least one of the control levers 14 and 34 is operated in a state in which the power reduction control is performed.

In addition, as characteristic functions of the controller 50, the controller 50 sets the above-described set time as a first set time Tth1 when an operation time until at least one control lever makes a transition to the non-operation state is longer than a monitoring time Tth0 set in advance, and sets the above-described set time as a second set time Tth2 shorter than the first set time Tth1 when the time until the at least one control lever makes a transition to the non-operation state is shorter than the monitoring time Tth0 set in advance.

In addition, the controller 50 generates non-operation flags F14(*t*) and F34(*t*) (non-operation state information) indicating that the control levers 14 and 34 are in a non-operation state and a power reduction flag F50(*t*) (power reduction control state information) indicating that the power reduction control is performed on the basis of the operation states of the control levers 14 and 34 (plurality of control levers) detected by the pressure sensors 17*b*, 17*r*, 27*b*, 27*r*, 37*b*, 37*r*, 47*l*, and 47*r* (plurality of operation state sensors), calculates a power non-reduction time during which the power reduction control is not performed on the basis of the non-operation flags F14(*t*) and F34(*t*) and the power reduction flag F50(*t*), and uses the power non-reduction time as the operation time of the control levers 14 and 34.

Further, the controller 50 determines that the operation of the at least one control lever is an erroneous operation when the transition is made from the state in which the at least one control lever is operated to the non-operation state in which none of the control levers 14 and 34 is operated and when the at least one control lever becomes non-operated during the monitoring time Tth0.

Details of the above-described basic concept of the controller 50 will be described in the following. Incidentally, in the following, description of the power reduction control based on the operation states of the control levers other than the control levers 14 and 34 will be omitted, and the power reduction control will be described with the operation states of the control levers 14 and 34 as a representative.

In FIG. 5, the controller 50 has respective functions of a sensor signal converting section 50*a*, a constant and table storage section 50*b*, and a power computing section 50*c*.

The sensor signal converting section 50*a* receives signals sent from the pressure sensors 17*b* to 47*r* and the switch 76, and converts the signals into pressure information and switch flag information. The sensor signal converting section 50*a* transmits the converted pressure information and the converted switch flag information to the power computing section 50*c*. The pressure information converted by the sensor signal converting section 50*a* is pressures generated in the lines 16*b* to 46*r* by driving the pilot valves 15*b* to 45*r*, and is shown as sensor values P17*b*(*t*), P17*r*(*t*), P27*b*(*t*), P27*r*(*t*), P37*b*(*t*), P37*r*(*t*), P47*l*(*t*), and P47*r*(*t*) in FIG. 5. The sensor values P17*b*(*t*), P17*r*(*t*), P27*b*(*t*), P27*r*(*t*), P37*b*(*t*), P37*r*(*t*), P47*l*(*t*), and P47*r*(*t*) may be referred to also as "operation pressures." In addition, as for the switch information converted by the sensor signal converting section 50*a*, in FIG. 5, the switch flag information is shown as a switch flag Fsw(t). The switch flag Fsw(t) is Fsw(t)=true (enabled) when the switch 76 is ON. The switch flag Fsw(t) is Fsw(t)=false (disabled) when the switch 76 is OFF.

The constant and table storage section 50*b* stores constants and tables necessary for calculation. The constant and table storage section 50*b* transmits these pieces of information to the power computing section 50*c*. The constants stored in the constant and table storage section 50*b* include the monitoring time Tth0, the first set time Tth1, and the second set time Tth2 described above.

The power computing section 50*c* receives the pressure information and the switch flag information transmitted from the sensor signal converting section 50*a*, target rotation speed information transmitted from the target rotation speed indicating device 77, and constant information (the monitoring time Tth0, the first set time Tth1, and the second set time Tth2) and table information transmitted from the constant and table storage section 50*b*, and computes the target rotation speed of the engine 6. Then, the power computing section 50*c* outputs the target rotation speed for control to the rotation speed controller 7.

(Power Computing Section 50*c*)

Figure 6:
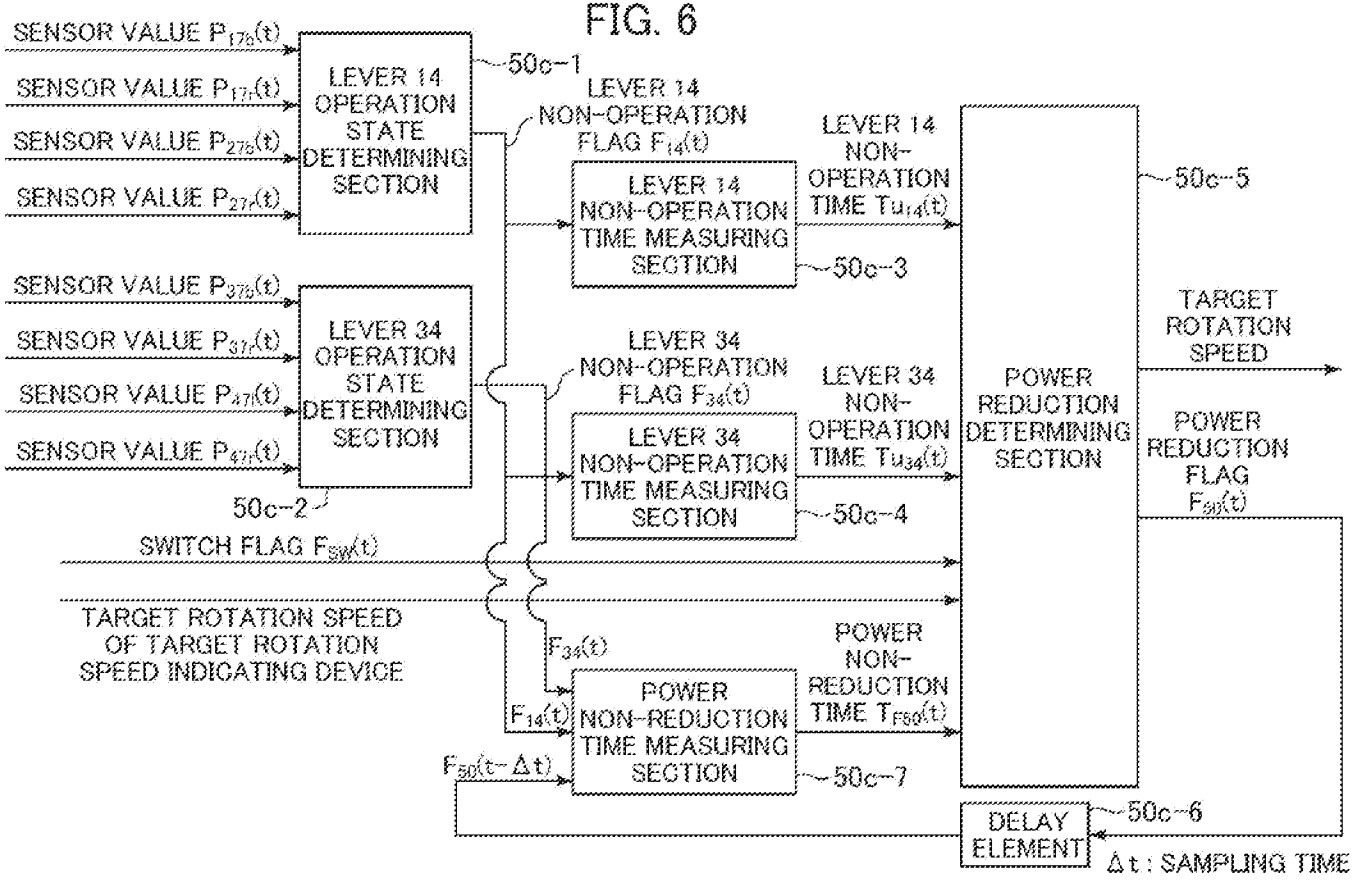
FIG. 6 is a block diagram showing functions of a power computing section in the first embodiment.

Functions of the power computing section 50*c* in the first embodiment will next be described. FIG. 6 is a block diagram showing functions of the power computing section 50*c*. Incidentally, suppose that a sampling time of the controller 50 is Δt.

In FIG. 6, the power computing section 50*c* has respective functions of a lever 14 operation state determining section 50*c*-1, a lever 34 operation state determining section 50*c*-2, a lever 14 non-operation time measuring section 50*c*-3, a lever 34 non-operation time measuring section 50*c*-4, a power reduction determining section 50*c*-5, a delay element 50*c*-6, and a power non-reduction time measuring section 50*c*-7.

The lever 14 operation state determining section 50*c*-1 determines whether the lever 14 is operated from the sensor values P17*b*(*t*), P17*r*(*t*), P27*b*(*t*), and P27*r*(*t*), and outputs the lever 14 non-operation flag F14(*t*). The lever 14 operation state determining section 50*c*-1 sets the lever 14 non-operation flag F14(*t*) true when determining that the lever 14 is not operated. The lever 14 operation state determining section 50*c*-1 sets the lever 14 non-operation flag F14(*t*) false when determining that the lever 14 is operated. This lever 14 non-operation flag F14(*t*) (which may hereinafter be referred to simply as flag information F14(*t*)) is transmitted to the lever 14 non-operation time measuring section 50*c*-3 and the power non-reduction time measuring section 50*c*-7.

The lever 34 operation state determining section 50*c*-2 determines whether the lever 34 is operated from the sensor values P37*b*(*t*), P37*r*(*t*), P47*l*(*t*), and P47*r*(*t*), and outputs the lever 34 non-operation flag F34(*t*). The lever 34 non-operation state determining section 50*c*-2 sets the lever 34 non-operation flag F34(*t*) true when determining that the lever 34 is not operated. The lever 34 non-operation state determining section 50*c*-2 sets the lever 34 non-operation flag F34(*t*) false when determining that the lever 34 is operated. This lever 34 non-operation flag F34(*t*) (which may hereinafter be referred to simply as flag information F34(*t*)) is transmitted to the lever 34 non-operation time measuring section 50*c*-4 and the power non-reduction time measuring section 50*c*-7.

The lever 14 non-operation time measuring section 50*c*-3 measures a lever 14 non-operation time Tu14(*t*) on the basis of the flag information F14(*t*), and transmits the lever 14 non-operation time Tu14(*t*) (which may hereinafter be referred to simply as time information Tu14(*t*)) to the power reduction determining section 50*c*-5.

The lever 34 non-operation time measuring section 50*c*-4 measures a lever 34 non-operation time Tu34(*t*) on the basis of the flag information F34(*t*), and transmits the lever 34 non-operation time Tu34(*t*) (which may hereinafter be referred to simply as time information Tu34(*t*)) to the power reduction determining section 50*c*-5.

The power non-reduction time measuring section 50*c*-7 measures a power non-reduction time TF50(*t*) on the basis of the flag information F14(*t*) and the flag information F34(*t*) and a power reduction flag F50(*t*−Δt) preceding by one step, which is generated by the delay element 50*c*-6, and transmits the power non-reduction time TF50(*t*) (which may hereinafter be referred to simply as time information TF50(*t*)) to the power reduction determining section 50*c*-5.

The power reduction determining section 50*c*-5 determines whether to reduce the target rotation speed for control on the basis of the time information Tu14(*t*) and Tu34(*t*) and the time information TF50(*t*), the switch flag Fsw(t), and the target rotation speed transmitted from the target rotation speed indicating device 77, and outputs the target rotation speed for control and the power reduction flag F50(*t*) on the basis of a result of the determination. In addition, the power reduction determining section 50*c*-5 sets the power reduction flag F50(*t*) true when determining that the target rotation speed is to be reduced, and the power reduction determining section 50*c*-5 sets the power reduction flag F50(*t*) false when determining that the target rotation speed is not to be reduced.

(Lever 14 Operation State Determining Section 50*c*-1)

Figure 7:
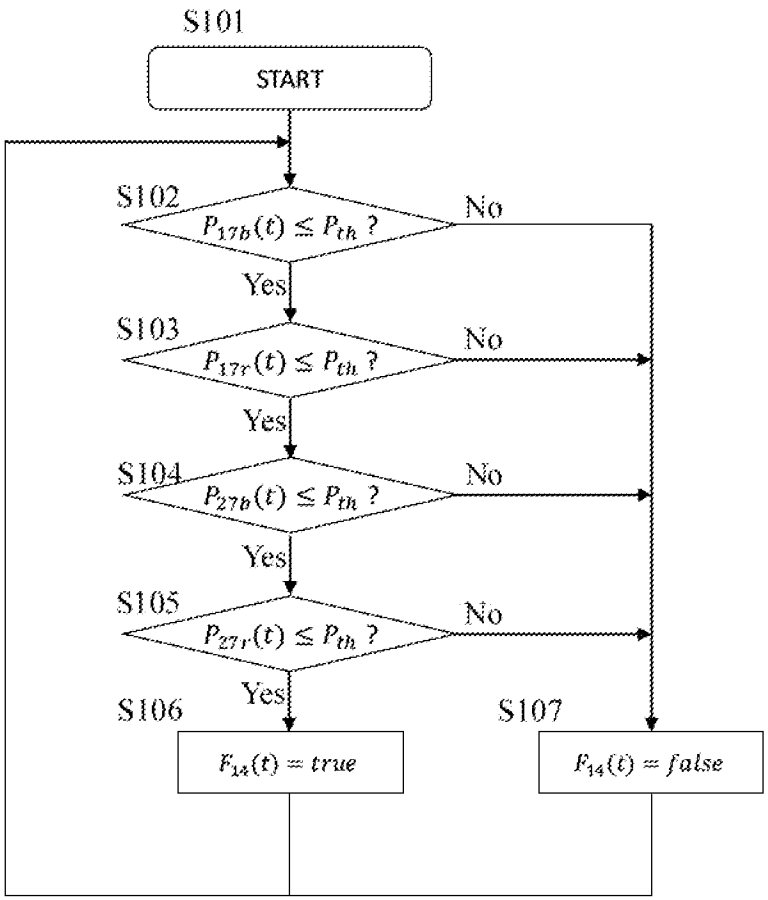
FIG. 7 is a flowchart showing a computation flow of a first lever operation state determining section in the first embodiment.

Functions of the lever 14 operation state determining section 50*c*-1 in the first embodiment will next be described. FIG. 7 is a flowchart showing a computation flow of the lever 14 operation state determining section 50*c*-1. This computation flow is processed repeatedly in each sampling time Δt while the controller 50 operates, for example.

The computation of the lever 14 operation state determining section 50*c*-1 is started in step S101.

In step S102, the lever 14 operation state determining section 50*c*-1 determines whether the sensor value P17*b*(*t*) is equal to or smaller than a threshold value Pth. When the sensor value P17*b*(*t*) is equal to or less than the threshold value Pth, the lever 14 operation state determining section 50*c*-1 determines Yes, and proceeds to the processing of step S103. When the sensor value P17*b*(*t*) is larger than the threshold value Pth, the lever 14 operation state determining section 50*c*-1 determines No, and proceeds to the processing of step S107.

In step S103, the lever 14 operation state determining section 50*c*-1 determines whether the sensor value P17*r*(*t*) is equal to or smaller than the threshold value Pth. When the sensor value P17$r(t)$ is equal to or smaller than the threshold value Pth, the lever 14 operation state determining section 50$c$-1 determines Yes, and proceeds to the processing of step S104. When the sensor value P17$r(t)$ is larger than the threshold value Pth, the lever 14 operation state determining section 50$c$-1 determines No, and proceeds to the processing of step S107.

In step S104, the lever 14 operation state determining section 50$c$-1 determines whether the sensor value P27$b(t)$ is equal to or smaller than the threshold value Pth. When the sensor value P27$b(t)$ is equal to or smaller than the threshold value Pth, the lever 14 operation state determining section 50$c$-1 determines Yes, and proceeds to the processing of step S105. When the sensor value P27$b(t)$ is larger than the threshold value Pth, the lever 14 operation state determining section 50$c$-1 determines No, and proceeds to the processing of step S107.

In step S105, the lever 14 operation state determining section 50$c$-1 determines whether the sensor value P27$r(t)$ is equal to or smaller than the threshold value Pth. When the sensor value P27$r(t)$ is equal to or smaller than the threshold value Pth, the lever 14 operation state determining section 50$c$-1 determines Yes, and proceeds to the processing of step S106. When the sensor value P27$r(t)$ is larger than the threshold value Pth, the lever 14 operation state determining section 50$c$-1 determines No, and proceeds to the processing of step S107.

In step S106, the lever 14 operation state determining section 50$c$-1 determines that the lever 14 is not operated, and sets the lever 14 non-operation flag F14($t$) true. Then, the lever 14 operation state determining section 50$c$-1 transmits the flag information to the lever 14 non-operation time measuring section 50$c$-3 and the power reduction determining section 50$c$-5.

In step S107, the lever 14 operation state determining section 50$c$-1 determines that the lever 14 is operated, and sets the lever 14 non-operation flag F14($t$) false. Then, the lever 14 operation state determining section 50$c$-1 transmits the flag information to the lever 14 non-operation time measuring section 50$c$-3 and the power reduction determining section 50$c$-5.

(Lever 34 Operation State Determining Section 50$c$-2)

Figure 8:
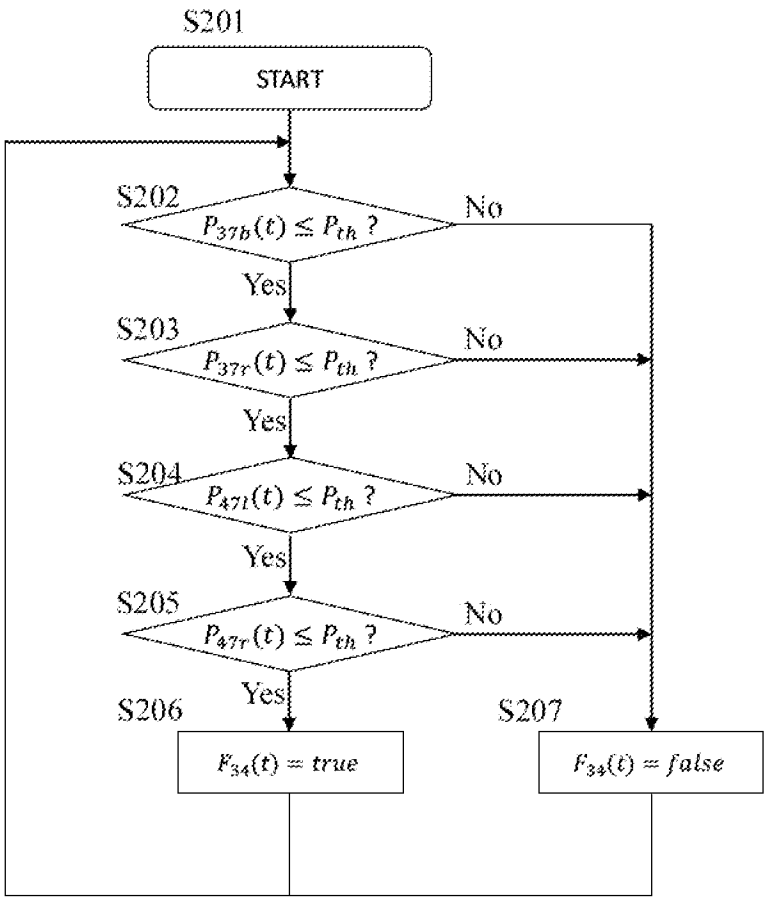
FIG. 8 is a flowchart showing a computation flow of a second lever operation state determining section in the first embodiment.

Functions of the lever 34 operation state determining section 50$c$-2 in the first embodiment will next be described. FIG. 8 is a flowchart showing a computation flow of the lever 34 operation state determining section 50$c$-2. This computation flow is processed repeatedly in each sampling time Δt while the controller 50 operates, for example.

The computation of the lever 34 operation state determining section 50$c$-2 is started in step S201.

In step S202, the lever 34 operation state determining section 50$c$-2 determines whether the sensor value P37$b(t)$ is equal to or smaller than the threshold value Pth. When the sensor value P37$b(t)$ is equal to or smaller than the threshold value Pth, the lever 34 operation state determining section 50$c$-2 determines Yes, and proceeds to the processing of step S203. When the sensor value P37$b(t)$ is larger than the threshold value Pth, the lever 34 operation state determining section 50$c$-2 determines No, and proceeds to the processing of step S207.

In step S203, the lever 34 operation state determining section 50$c$-2 determines whether the sensor value P37$r(t)$ is equal to or smaller than the threshold value Pth. When the sensor value P37$r(t)$ is equal to or smaller than the threshold value Pth, the lever 34 operation state determining section 50$c$-2 determines Yes, and proceeds to the processing of step S204. When the sensor value P37$r(t)$ is larger than the threshold value Pth, the lever 34 operation state determining section 50$c$-2 determines No, and proceeds to the processing of step S207.

In step S204, the lever 34 operation state determining section 50$c$-2 determines whether the sensor value P47$l(t)$ is equal to or smaller than the threshold value Pth. When the sensor value P47$l(t)$ is equal to or smaller than the threshold value Pth, the lever 34 operation state determining section 50$c$-2 determines Yes, and proceeds to the processing of step S205. When the sensor value P47$l(t)$ is larger than the threshold value Pth, the lever 34 operation state determining section 50$c$-2 determines No, and proceeds to the processing of step S207.

In step S205, the lever 34 operation state determining section 50$c$-2 determines whether the sensor value P47$r(t)$ is equal to or smaller than the threshold value Pth. When the sensor value P47$r(t)$ is equal to or smaller than the threshold value Pth, the lever 34 operation state determining section 50$c$-2 determines Yes, and proceeds to the processing of step S206. When the sensor value P47$r(t)$ is larger than the threshold value Pth, the lever 34 operation state determining section 50$c$-2 determines No, and proceeds to the processing of step S207.

In step S206, the lever 34 operation state determining section 50$c$-2 determines that the lever 34 is not operated, and sets the lever 34 non-operation flag F34($t$) true. Then, the lever 34 operation state determining section 50$c$-2 transmits the flag information to the lever 34 non-operation time measuring section 50$c$-4 and the power reduction determining section 50$c$-5.

In step S207, the lever 34 operation state determining section 50$c$-2 determines that the lever 14 is operated, and sets the lever 34 non-operation flag F34($t$) false. Then, the lever 34 operation state determining section 50$c$-2 transmits the flag information to the lever 34 non-operation time measuring section 50$c$-4 and the power reduction determining section 50$c$-5.

(Definition of Threshold Value Pth)

Figure 9:
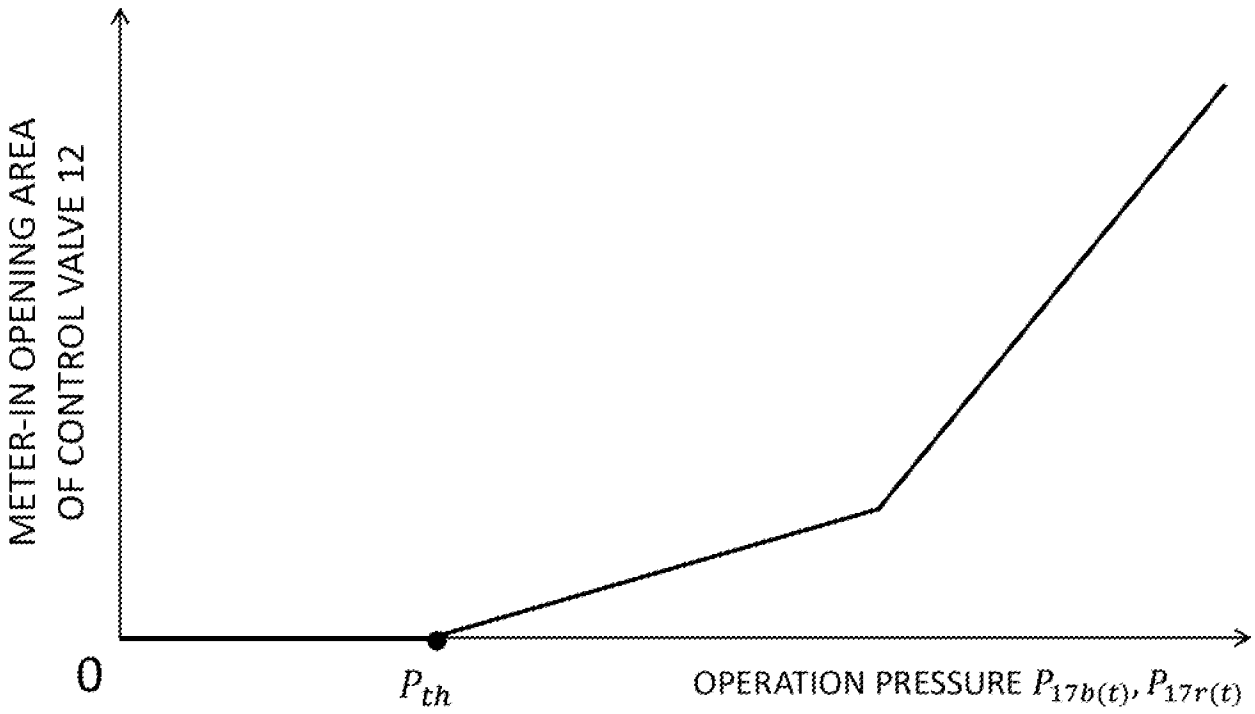
FIG. 9 is a diagram showing relation between a sensor value and the meter-in opening area of a directional control valve in the first embodiment, and also showing a definition of a threshold value of operation pressure.

A definition of the threshold value Pth for the above-described sensor values will be described with reference to FIG. 9. FIG. 9 shows relation between the sensor value P17$b(t)$ or P17$r(t)$ and the meter-in opening area of the directional control valve 12. In addition, the sensor value P17$b(t)$ or P17$r(t)$ is represented as an "operation pressure."

In FIG. 9, until the operation pressure P17$b(t)$ or P17$r(t)$ becomes the value of Pth, a meter-in opening does not open, and therefore the hydraulic cylinder (boom cylinder) 13 is not actuated. This relation is the same for the other directional control valves. The operation state determining sections 50$c$-1 and 50$c$-2 use the pressure value Pth at which the meter-in opening opens as a threshold value.

(Lever 14 Non-Operation Time Measuring Section 50$c$-3)

Figure 10:
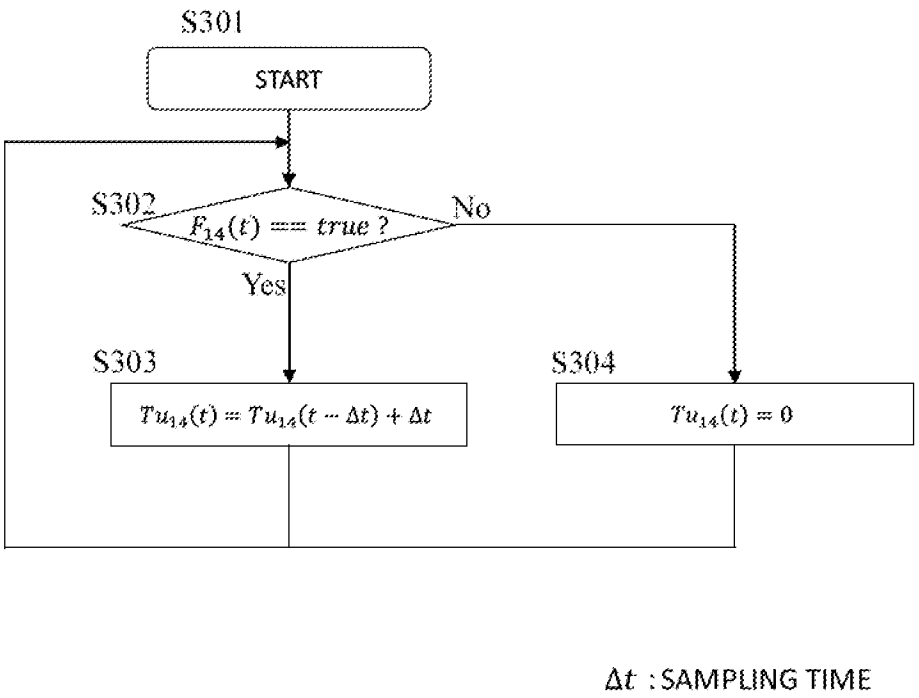
FIG. 10 is a flowchart showing a computation flow of a first lever non-operation time measuring section in the first embodiment.

Functions of the lever 14 non-operation time measuring section 50$c$-3 in the first embodiment will next be described. FIG. 10 is a flowchart showing a computation flow of the lever 14 non-operation time measuring section 50$c$-3. This computation flow is processed repeatedly in each sampling time Δt while the controller 50 operates, for example.

The computation of the lever 14 non-operation time measuring section 50$c$-3 is started in step S301.

In step S302, the lever 14 non-operation time measuring section 50$c$-3 determines whether the lever 14 non-operation flag F14($t$) is true. When the lever 14 non-operation flag F14($t$) is true, the lever 14 non-operation time measuring section 50$c$-3 determines Yes, and proceeds to the processing of step S303. When the lever 14 non-operation flag F14(*t*) is false, the lever 14 non-operation time measuring section 50*c*-3 determines No, and proceeds to the processing of step S304.

In step S303, since the lever 14 is not operated, the lever 14 non-operation time measuring section 50*c*-3 sets, as a new lever 14 non-operation time Tu14(*t*), a value obtained by adding a sampling time Δt to a retained lever 14 non-operation time Tu14(*t*−Δt) preceding by one step. Then, the lever 14 non-operation time measuring section 50*c*-3 transmits the information to the power reduction determining section 50*c*-5.

In step S304, since the lever 14 is operated, the lever 14 non-operation time measuring section 50*c*-3 sets the lever 14 non-operation time Tu14(*t*) to zero. Then, the lever 14 non-operation time measuring section 50*c*-3 transmits the information to the power reduction determining section 50*c*-5.

(Lever 34 Non-Operation Time Measuring Section 50*c*-4)

Figure 11:
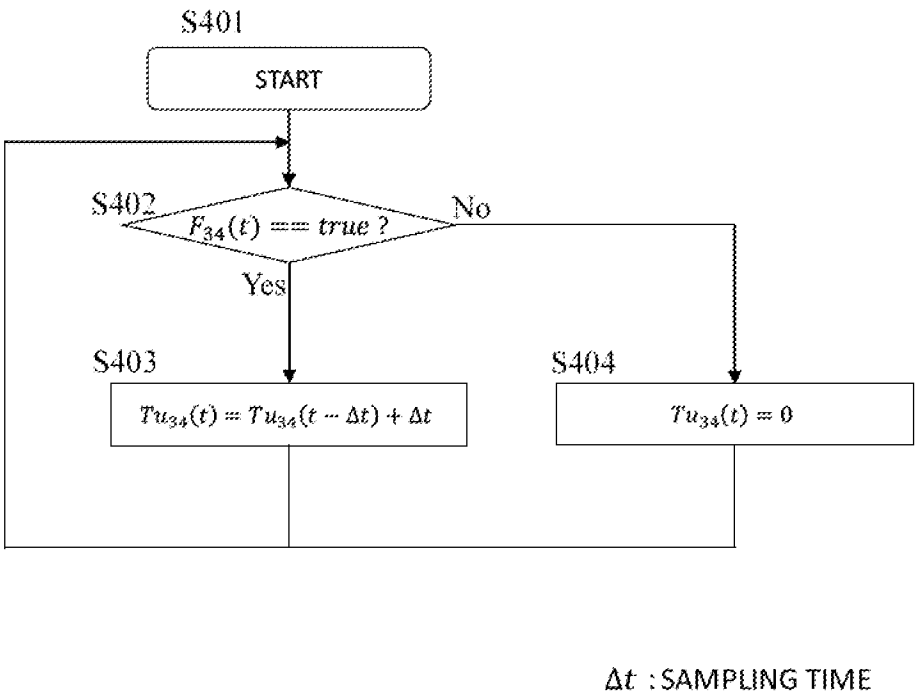
FIG. 11 is a flowchart showing a computation flow of a second lever non-operation time measuring section in the first embodiment.

Functions of the lever 34 non-operation time measuring section 50*c*-4 in the first embodiment will next be described. FIG. 11 is a flowchart showing a computation flow of the lever 34 non-operation time measuring section 50*c*-4. This computation flow is processed repeatedly in each sampling time Δt while the controller 50 operates, for example.

The computation of the lever 34 non-operation time measuring section 50*c*-4 is started in step S401.

In step S402, the lever 34 non-operation time measuring section 50*c*-4 determines whether the lever 34 non-operation flag F34(*t*) is true. When the lever 34 non-operation flag F34(*t*) is true, the lever 34 non-operation time measuring section 50*c*-4 determines Yes, and proceeds to the processing of step S403. When the lever 34 non-operation flag F34(*t*) is false, the lever 34 non-operation time measuring section 50*c*-4 determines No, and proceeds to the processing of step S404.

In step S403, since the lever 34 is not operated, the lever 34 non-operation time measuring section 50*c*-4 sets, as a new lever 34 non-operation time Tu34(*t*), a value obtained by adding a sampling time Δt to a retained lever 34 non-operation time Tu34(*t*−Δt) preceding by one step. Then, the lever 34 non-operation time measuring section 50*c*-4 transmits the information to the power reduction determining section 50*c*-5.

In step S404, since the lever 34 is operated, the lever 34 non-operation time measuring section 50*c*-4 sets the lever 34 non-operation time Tu34(*t*) to zero. Then, the lever 34 non-operation time measuring section 50*c*-4 transmits the information to the power reduction determining section 50*c*-5.

(Power Non-Reduction Time Measuring Section 50*c*-7)

Figure 12:
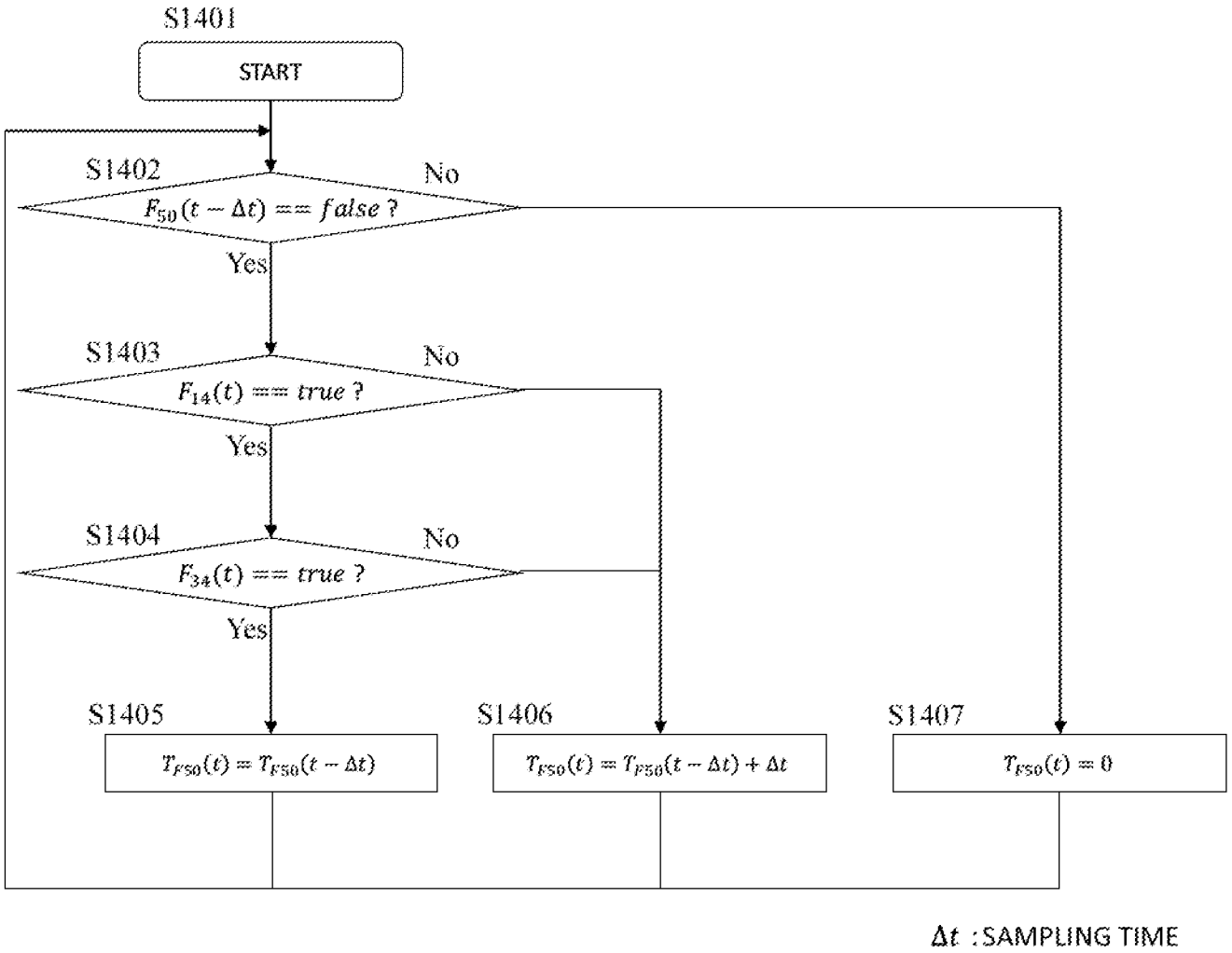
FIG. 12 is a flowchart showing a computation flow of a power non-reduction time measuring section in the first embodiment.

Functions of the power non-reduction time measuring section 50*c*-7 in the first embodiment will next be described. FIG. 12 is a flowchart showing a computation flow of the power non-reduction time measuring section 50*c*-7. This computation flow is processed repeatedly in each sampling time Δt while the controller 50 operates, for example.

The computation of the power non-reduction time measuring section 50*c*-7 is started in step S1401.

In step S1402, the power non-reduction time measuring section 50*c*-7 determines whether the power reduction flag F50(*t*−Δt) preceding by one step is false. When the power reduction flag F50(*t*−Δt) is false, the power non-reduction time measuring section 50*c*-7 determines Yes, and proceeds to the processing of step S1403. When the power reduction flag F50(*t*−Δt) is true, the power non-reduction time measuring section 50*c*-7 determines No, and proceeds to the processing of step S1407.

In step S1403, the power non-reduction time measuring section 50*c*-7 determines whether the lever 14 non-operation flag F14(*t*) is true. When the lever 14 non-operation flag F14(*t*) is true, the power non-reduction time measuring section 50*c*-7 determines Yes, and proceeds to the processing of step S1404. When the lever 14 non-operation flag F14(*t*) is false, the power non-reduction time measuring section 50*c*-7 determines No, and proceeds to the processing of step S1406.

In step S1404, the power non-reduction time measuring section 50*c*-7 determines whether the lever 34 non-operation flag F34(*t*) is true. When the lever 34 non-operation flag F34(*t*) is true, the power non-reduction time measuring section 50*c*-7 determines Yes, and proceeds to the processing of step S1405. When the lever 34 non-operation flag F34(*t*) is false, the power non-reduction time measuring section 50*c*-7 determines No, and proceeds to the processing of step S1406.

In step S1406, since the power reduction flag F50(*t*−Δt) is false and thus does not indicate a power reduction state, and at least one of the lever 14 non-operation flag F14(*t*) and the lever 34 non-operation flag F34(*t*) is not true (at least one of the levers 14 and 34 is operated), the power non-reduction time measuring section 50*c*-7 sets, as a new power non-reduction time TF50(*t*), a value obtained by adding a sampling time Δt to the power non-reduction time TF50(*t*−Δt) preceding by one step. Then, the power non-reduction time measuring section 50*c*-7 transmits the information to the power reduction determining section 50*c*-5.

In step S1405, when the power reduction flag F50(*t*−Δt) is false and thus does not indicate a power reduction state, and both the lever 14 non-operation flag F14(*t*) and the lever 34 non-operation flag F34(*t*) become true (both of the levers 14 and 34 become non-operated), the power non-reduction time measuring section 50*c*-7 sets the power non-reduction time TF50(*t*−Δt) preceding by one step as a new power non-reduction time TF50(*t*), and retains the power non-reduction time TF50(*t*−Δt) preceding by one step as the power non-reduction time TF50(*t*). Then, the power non-reduction time measuring section 50*c*-7 transmits the information to the power reduction determining section 50*c*-5.

Here, the power non-reduction time TF50(*t*) set in step S1405 (power non-reduction time TF50(*t*−Δt) preceding by one step) means an operation time from a time that at least one of the levers 14 and 34 is operated (power reduction control is canceled) to a time that both of the levers 14 and 34 become non-operated (power reduction control is performed again).

In step S1407, since the power reduction flag F50(*t*−Δt) is not false and thus indicates a power reduction state, the power non-reduction time measuring section 50*c*-7 sets the power non-reduction time TF50(*t*) to zero. Then, the power non-reduction time measuring section 50*c*-7 transmits the information to the power reduction determining section 50*c*-5.

(Power Reduction Determining Section 50*c*-5)

Figure 13:
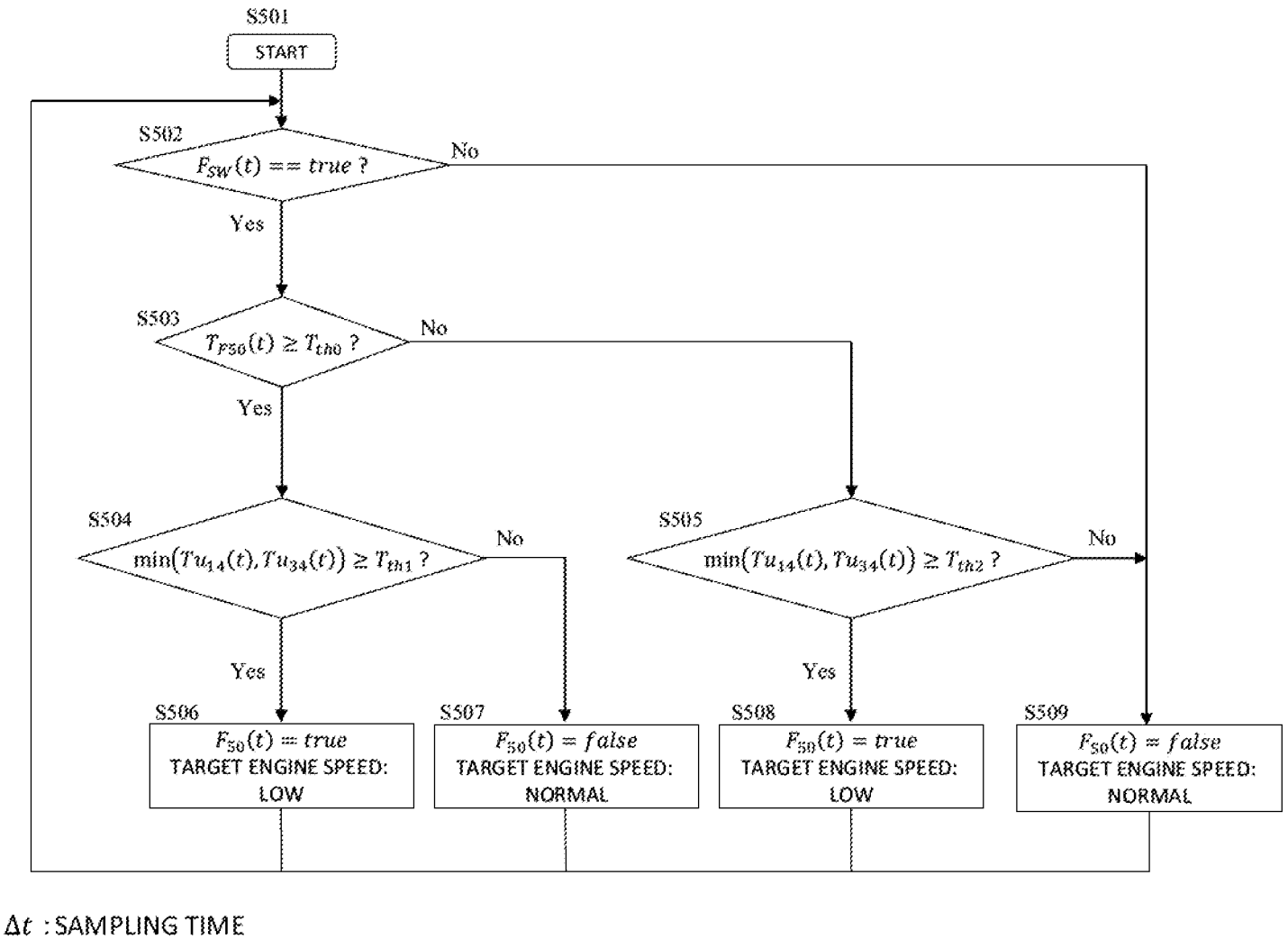
FIG. 13 is a flowchart showing a computation flow of a power reduction determining section in the first embodiment.

Functions of the power reduction determining section 50*c*-5 in the first embodiment will next be described. FIG. 13 is a flowchart showing a computation flow of the power reduction determining section 50*c*-5. This computation flow is processed repeatedly in each sampling time Δt while the controller 50 operates, for example.

The computation of the power reduction determining section 50*c*-5 is started in step S501.

In step S502, the power reduction determining section 50*c*-5 determines whether the switch flag Fsw(t) is true. When the switch flag Fsw(t) is true, the power reduction determining section 50c-5 determines Yes, and proceeds to the processing of step S503. When the switch flag Fsw(t) is false, the power reduction determining section 50c-5 determines No, and proceeds to the processing of step S509.

In step S503, the power reduction determining section 50c-5 determines whether the power non-reduction time TF50(t) is equal to or more than a preset monitoring time Tth0 for an erroneous operation of the lever 14 or 34. When the power non-reduction time TF50(t) is equal to or more than the monitoring time Tth0, the power reduction determining section 50c-5 determines Yes, and proceeds to the processing of step S504. When the power non-reduction time TF50(t) is smaller than the monitoring time Tth0, the power reduction determining section 50c-5 determines No, and proceeds to the processing of step S505. The power non-reduction time TF50(t) corresponds to an operation time from a time of a start of operation of the control lever 14 or 34, as described above. Incidentally, instead of using the power non-reduction time TF50(t) as the operation time, the operation time of the levers 14 and 37 may be calculated by directly using the sensor values P17b(t), P17r(t), P27b(t), P27r(t), P37b(t), P37r(t), P47l(t), and P47r(t) (operation pressures) of the pressure sensors 17b to 47r, and the operation time may be used.

In step S504, the power reduction determining section 50c-5 determines whether a smaller value of the lever 14 non-operation time Tu14(t) and the lever 34 non-operation time Tu34(t) is equal to or more than the first set time Tth1 as a normal power reduction control time. When the smaller value of the lever 14 non-operation time Tu14(t) and the lever 34 non-operation time Tu34(t) is equal to or more than the first set time Tth1, the power reduction determining section 50c-5 determines Yes, and proceeds to the processing of step S506. When the smaller value of the lever 14 non-operation time Tu14(t) and the lever 34 non-operation time Tu34(t) is smaller than the first set time Tth1, the power reduction determining section 50c-5 determines No, and proceeds to the processing of step S507.

In step S505, the power reduction determining section 50c-5 determines whether the smaller value of the lever 14 non-operation time Tu14(t) and the lever 34 non-operation time Tu34(t) is equal to or more than the second set time Tth2. When the smaller value of the lever 14 non-operation time Tu14(t) and the lever 34 non-operation time Tu34(t) is equal to or more than the second set time Tth2, the power reduction determining section 50c-5 determines Yes, and proceeds to the processing of step S508. When the smaller value of the lever 14 non-operation time Tu14(t) and the lever 34 non-operation time Tu34(t) is smaller than the second set time Tth2, the power reduction determining section 50c-5 determines No, and proceeds to the processing of step S509.

Incidentally, the second set time Tth2 is set shorter than the first set time Tth1 as a normal power reduction control time. The first set time Tth1 is for example 3 to 5 seconds. The second set time Tth2 is for example 0.5 to 2 seconds.

In addition, the monitoring time Tth0 is set at a maximum value of a time for which an erroneous operation of the lever 14 or 34 can be considered to be performed. It is thereby possible to monitor the operation time (power non-reduction time TF50(t)) of the lever 14 or 34 during the monitoring time Tth0, and determine that an erroneous operation is performed when the operation time is shorter than the monitoring time Tth0.

The maximum value of the operation time for which an erroneous operation of the lever 14 or 34 can be considered to be performed can be determined by collecting data on the operation time in advance. In a case where the first set time Tth1 is for example 3 to 5 seconds, and the second set time Tth2 is for example 0.5 to 2 seconds, the monitoring time Tth0 is for example 1 to 2.5 seconds.

The power reduction determining section 50c-5 performs same processing in step S506 and step S508. Specifically, in step S506 and step S508, the power reduction determining section 50c-5 sets the power reduction flag true, and at the same time, the power reduction determining section 50c-5 sets the target rotation speed for controlling the engine 6 to a target rotation speed for power reduction control, which is lower than a normal target rotation speed indicated by the target rotation speed indicating device 77. Then, the power reduction determining section 50c-5 transmits the target rotation speed to the rotation speed controller 7. The rotation speed controller 7 decreases the rotation speed of the engine 6 by reducing an amount of fuel supplied to the engine 6. The power reduction determining section 50c-5 thus performs power reduction control in step S506 and step S508.

The power reduction determining section 50c-5 performs same processing in step S507 and step S509. Specifically, in step S507 and step S509, the power reduction determining section 50c-5 sets the power reduction flag F50(t) false, and at the same time, the power reduction determining section 50c-5 sets the target rotation speed for controlling the engine 6 to the normal target rotation speed indicated by the target rotation speed indicating device 77. Then, the power reduction determining section 50c-5 transmits the target rotation speed to the rotation speed controller 7. The rotation speed controller 7 increases the rotation speed of the engine 6 by increasing the amount of fuel supplied to the engine 6. The power reduction determining section 50c-5 thus cancels the power reduction control in step S507 and step S509.

~Operation~

Figure 14:
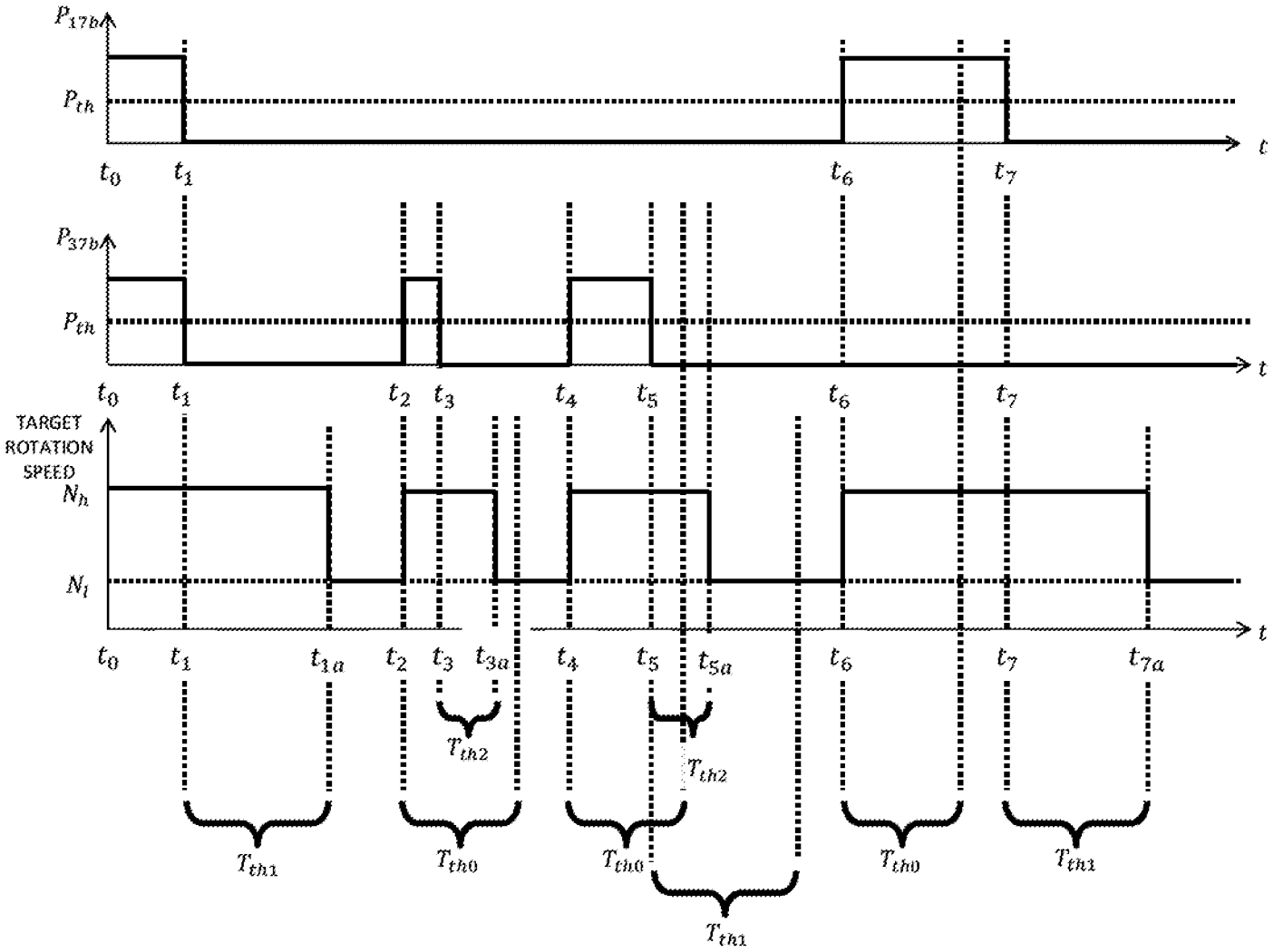
FIG. 14 is a timing diagram showing an example of changes in operation pressure and target rotation speed when the levers are operated in the first embodiment.

An example of changes in operation pressures and target rotation speed in the first embodiment will next be described with reference to FIG. 14. FIG. 14 is a timing diagram showing an example of changes in operation pressures and target rotation speed when the levers 14 and 34 are operated. An upper graph in FIG. 14 indicates temporal changes in the operation pressure P17b(t) by the lever 14. A central graph indicates temporal changes in the operation pressure P37b(t) by the lever 34. A lower graph indicates temporal changes in target rotation speed. An axis of abscissas in all of the graphs indicates time (seconds). In addition, the operation pressure threshold value Pth is also provided in the upper graph and the central graph.

At time t0, the lever 14 is operated in the forward direction 14b, and the lever 34 is operated in the right direction 34b. Therefore, both the operation pressure P17b(t) and the operation pressure P37b(t) exceed the threshold value Pth. The other operation pressures not shown in the figure are zero. At this time, the processing of step S507 in FIG. 13 is performed (S502→S503→S504→S507), and the target rotation speed for controlling the engine 6 is thereby set to a normal value Nh indicated by the target rotation speed indicating device 77. That is, the power reduction control (auto idle control) is canceled.

From time t0 to time t1, the operation pressures P17b(t) and P37b(t) are both larger than the threshold value Pth. Also in this case, the processing of step S507 in FIG. 13 is performed (S502→S503→S504→S507), and the target rotation speed is thereby set to the normal value Nh.

At time t1, both of the levers 14 and 34 are returned to neutral, and thus both of the operation pressures P17b(t) and P37b(t) are a value smaller than the threshold value Pth. Therefore, until the first set time Tth1 passes from time t1, the processing of step S507 is performed (S502→S503→S504→S507), and the target rotation speed for controlling the engine 6 is thereby set to the normal value Nh so that normal power control is performed. When the first set time Tth1 thereafter passes from time t1, the processing of step S506 in FIG. 13 is performed (S502→S503→S504→S506) at time t1*a*, and the target rotation speed for controlling the engine 6 is thereby set to a value Nl smaller than the normal value Nh in the power reduction control (auto idle control) so that a transition is made to the power reduction control. Thereafter, the power reduction control is performed, and the power non-reduction time TF50(*t*) becomes zero. Thus, the processing of step S508 in FIG. 13 is performed, and the power reduction control is thereby continued (S502→S503→S505→S508).

At time t2, the operation pressure P37*b*(*t*) is larger than the threshold value Pth due to an erroneous operation of the lever 34. At this time, the processing of step S509 in FIG. 13 is performed (S502→S503→S505→S509), and the target rotation speed for controlling the engine 6 thereby returns to the normal value Nh so that the power reduction control is canceled.

Thereafter, at time t3, the lever 34 returns to neutral, and the operation pressure P37*b*(*t*) is thereby decreased, thus both of the operation pressures P17*b*(*t*) and P37*b*(*t*) become a value smaller than the threshold value Pth (non-operation state). Therefore, until the second set time Tth2 passes from time t3, the processing of step S509 is performed (S502→S503→S505→S509), and the target rotation speed for controlling the engine 6 thereby continues to be set to the normal value Nh so that the normal power control is performed. When the seconds of the second set time Tth2 thereafter pass from time t3, the processing of step S508 in FIG. 13 is performed (S502→S503→S505→S508) at time t3*a*. The target rotation speed for controlling the engine 6 is thereby set to the value Nl smaller than the normal value Nh in the power reduction control (auto idle control) so that a transition is made to the power reduction control.

Incidentally, a time from time t2 to time t3 is an erroneous operation time of the lever 34. Since the erroneous operation monitoring time Tth0 is set to the maximum value of the time for which an erroneous operation can be considered to be performed, it is possible to reliably monitor the erroneous operation time in step 503, proceed to step S508 in the second set time Tth2 shorter than the first set time Tth1, and perform the power reduction control.

Thereafter, at time t4, the operation pressure P37*b*(*t*) becomes larger than the threshold value Pth again due to an erroneous operation of the lever 34. Also in this case, the processing of step S509 in FIG. 13 is performed (S502→S503→S505→S509) so that the power reduction control is canceled.

Thereafter, at time t5, the lever 34 returns to neutral, and the operation pressure P37*b*(*t*) is thereby decreased, thus both of the operation pressures P17*b*(*t*) and P37*b*(*t*) become a value smaller than the threshold value Pth (non-operation state). Therefore, also in this case, until the second set time Tth2 passes from time t5, the processing of step S509 is performed (S502→S503→S505→S509), and the target rotation speed for controlling the engine 6 thereby continues to be set to the normal value Nh so that the normal power control is performed. When the second set time Tth2 thereafter passes from time t5, the processing of step S508 in FIG. 13 is performed (S502→S503→S505→S508) at time t5*a*, and the target rotation speed for controlling the engine 6 is thereby set to the value Nl smaller than the normal value Nh in the power reduction control (auto idle control) so that a transition is made to the power reduction control.

Incidentally, an erroneous operation time t4 to t5 in this case is longer than the erroneous operation time t2 to t3. However, the erroneous operation monitoring time Tth0 is set to the maximum value of the time for which an erroneous operation can be considered to be performed. Thus, the determination in step S503 continues to be negative during the erroneous operation. It is therefore possible to reliably monitor an erroneous operation in step 503, proceed to step S508 in the second set time Tth2 shorter than the first set time Tth1 also in this case, and perform the power reduction control.

Thereafter, at time t6, the lever 14 is operated by the operator intending to perform work. At time t7, the lever 34 is returned to neutral.

At time t6, the operation pressure P17*b*(*t*) is larger than the threshold value Pth. At this time, the processing of step S509 in FIG. 13 is performed (S502→S503→S505→S509), and the target rotation speed for controlling the engine 6 is thereby set to the normal value Nh so that the power reduction control is canceled.

An operation time from time t6 to time t7 is an operation time in which work is intended, and is longer than the erroneous operation monitoring time Tth0. Therefore, until the monitoring time Tth0 passes from time t6, the processing of step S509 is performed (S502→S503→S505→S509), and the target rotation speed for controlling the engine 6 thereby continues to be set to the normal value Nh so that the normal power control is performed. When the seconds of the monitoring time Tth0 pass from time t6, the processing of step S507 is performed (S502→S503→S504→S507) until time t7. Also in this case, the target rotation speed for controlling the engine 6 continues to be set to the normal value Nh so that the normal power control is performed.

When the lever 34 is thereafter returned to neutral at time t7, the operation pressure P17*b*(*t*) decreases, thus both of the operation pressures P17*b*(*t*) and P37*b*(*t*) become a value smaller than the threshold value Pth (non-operation state). Therefore, until the first set time Tth1 passes from time t7, the processing of step S507 is performed (S502→S503→S504→S507), and the target rotation speed for controlling the engine 6 thereby continues to be set to the normal value Nh so that the normal power control is performed. When the first set time Tth1 thereafter passes from time t7, the processing of step S506 in FIG. 13 is performed (S502→S503→S504→S506) at time t7*a*, and the target rotation speed for controlling the engine 6 is thereby set to the value Nl smaller than the normal value Nh in the power reduction control (auto idle control) so that a transition is made to the power reduction control. Thereafter, the power reduction control is performed, and the power non-reduction time TF50(*t*) becomes zero. Thus, the processing of step S508 in FIG. 13 is performed, and the power reduction control is continued (S502→S503→S505→S508).

~Effects~

As described above, according to the present embodiment, the controller 50 performs the power reduction control that reduces the power output by the engine 6 and the hydraulic pump 1 (power source) when a transition is made from a state in which at least one of the control levers 14 and 34 (plurality of control levers) is operated to a non-operation state in which none of the control levers 14 and 34 is operated and a non-operation time after the transition to the non-operation state exceeds the set time Tth1 or Tth2. When at least one of the control levers 14 and 34 is operated in a state in which the power reduction control is performed, the controller 50 cancels the power reduction control, and restores the power output by the engine 6 and the hydraulic pump 1 to the power before the reduction.

It is thereby possible to perform the power reduction control during non-operation of the control levers, and make a smooth transition to an operation desired to be performed at a time of a return to a normal power state.

In addition, the controller 50 sets the set time as the first set time Tth1 when an operation time until at least one control lever makes a transition to the non-operation state is longer than the monitoring time Tth0 set in advance, and the controller 50 sets the set time as the second set time Tth2 shorter than the first set time Tth1 when the operation time until the at least one control lever makes a transition to the non-operation state is shorter than the monitoring time Tth0 set in advance. Therefore, when the control lever(s) 14 and/or 34 is moved by an erroneous operation, the power reduction control is temporarily canceled, and a return is made to a normal power state. However, a return is thereafter made to a power reduction state in a short time.

It is thereby possible to suppress power consumption of the engine 6 (power source) and thus reduce an amount of fuel consumed by the engine 6 (energy consumption) when the control lever(s) 14 and/or 34 is moved by an erroneous operation.

In addition, the controller 50 generates the non-operation flags F14(*t*) and F34(*t*) (non-operation state information) and the power reduction flag F50(*t*) (power reduction control state information) on the basis of the operation states of the control levers 14 and 34, which are detected by the pressure sensors 17*b*, 17*r*, 27*b*, 27*r*, 37*b*, 37*r*, 47*l*, and 47*r* (plurality of operation state sensors), calculates the power non-reduction time TF50(*t*) on the basis of the non-operation flags F14(*t*) and F34(*t*) and the power reduction flag F50, and uses this power non-reduction time TF50(*t*) as the operation time of the control levers 14 and 34. It is thereby possible to simplify the control computation of the controller 50.

Second Embodiment

A second embodiment of the present invention will be described with reference to FIGS. 15 to 18. Incidentally, description of the present embodiment will be made centering on parts different from those of the first embodiment and a second modification, and description of parts similar to those of the first embodiment will be omitted.

Figure 15:
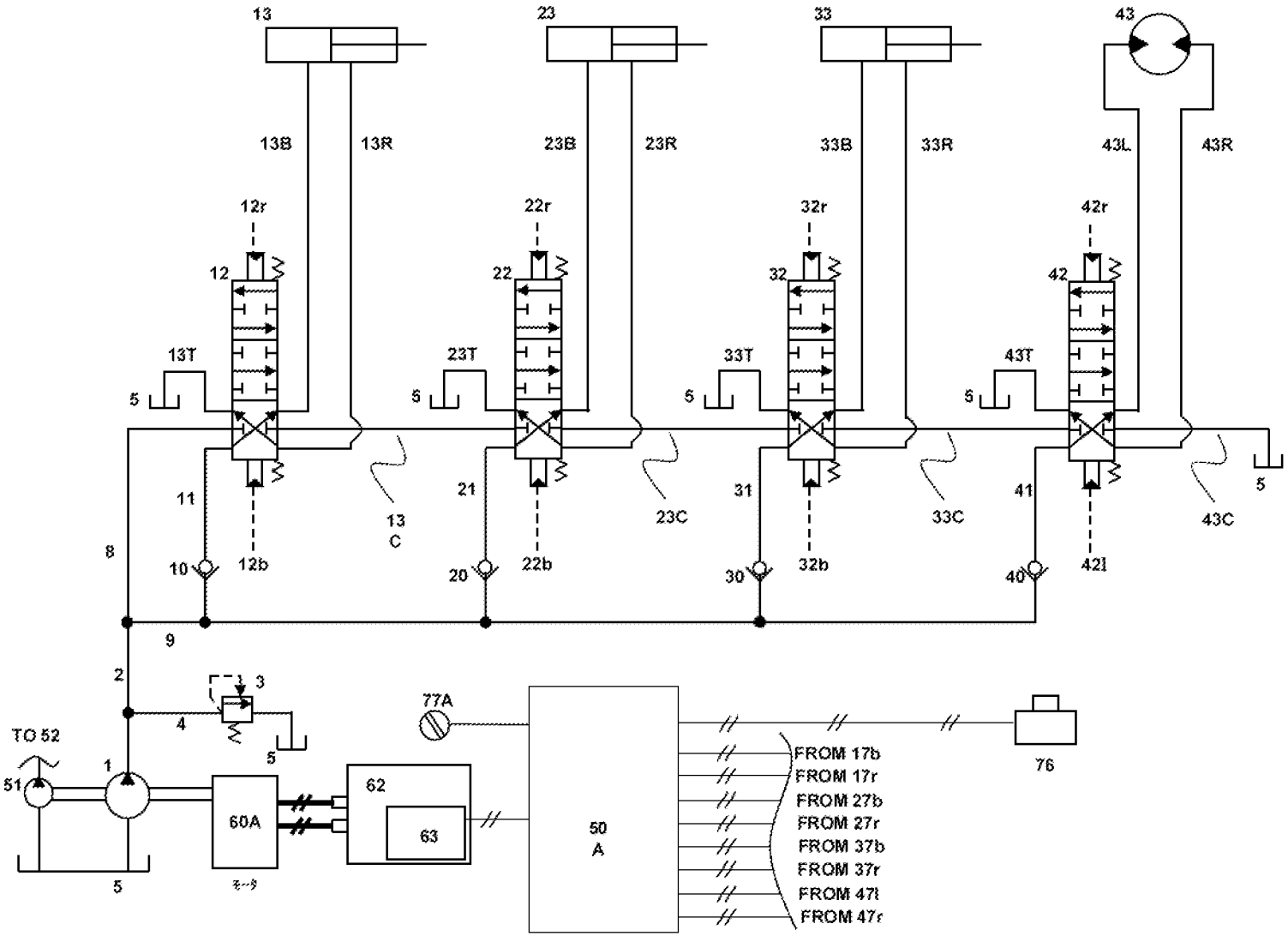
FIG. 15 is a diagram showing a configuration of a driving system in a second embodiment.

A configuration of a driving system in the second embodiment will first be described. FIG. 15 is a diagram showing a configuration of a driving system in the present embodiment.

In FIG. 15, the driving system in the second embodiment and the second modification is different from that in the first embodiment in that the hydraulic pump 1 is driven by a direct-current electric motor 60A. The electric motor 60A is electrically connected to a battery 62, and is driven by electric power supplied from the battery 62. The electric power output from the battery 62 is controlled by a battery output power control panel 63. The battery output power control panel 63 is electrically connected to a controller 50A.

The battery output power control panel 63 controls the electric power output by the battery 62 on the basis of target battery output power information transmitted from the controller 50A. The target rotation speed indicating device 77 is replaced with a target electric power indicating device 77A.

Here, the battery 62 constitutes an electric power supply device, and this electric power supply device, the electric motor 60A, and the hydraulic pump 1 constitute a power source. In addition, the power source drives the electric motor 60A by electric power supply from the electric power supply device (battery 62), and generates power by driving the hydraulic pump 1 by the electric motor 60A.

Figure 16:
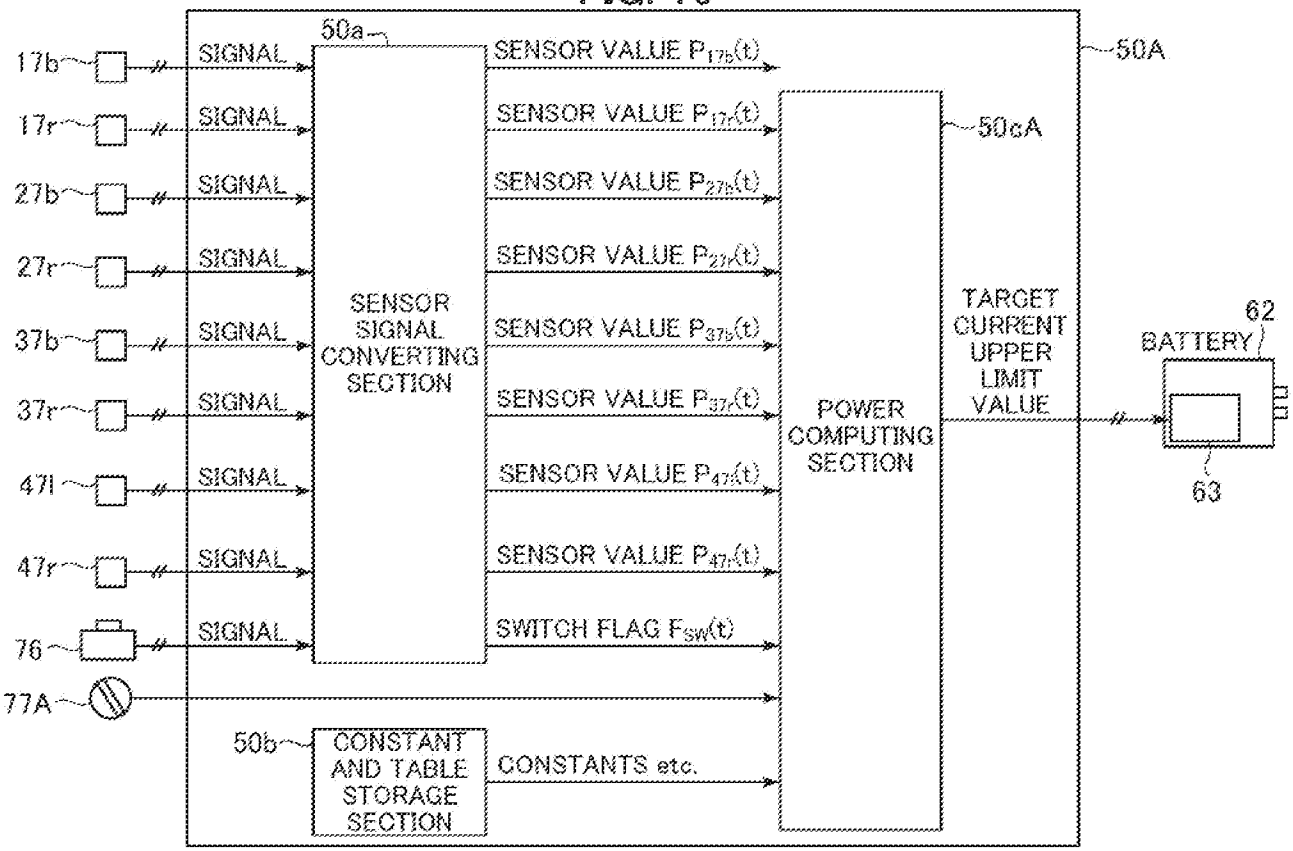
FIG. 16 is a block diagram showing functions of a controller in the second embodiment.

Functions of the controller 50A in the second embodiment will next be described. FIG. 16 is a block diagram showing functions of the controller 50A.

The controller 50A performs power reduction control by reducing the electric power supplied to the electric motor 60A and thus reducing the rotation speed of the electric motor 60A.

Details of the above-described functions of the controller 50A will be described in the following. FIG. 16 is a block diagram showing functions of the controller 50A.

In FIG. 16, the controller 50A in the second embodiment is different from that in the first embodiment in that the controller 50A includes a power computing section 50*c*A in place of the power computing section 50*c*, and the power computing section 50*c*A receives the pressure information and the switch flag transmitted from the sensor signal converting section 50*a*, the constant information and the table information transmitted from the constant and table storage section 50*b*, and a target voltage transmitted from the target voltage indicating device 77A, and computes a target current upper limit value as an output power target value of the battery 62. The target current upper limit value computed by the power computing section 50*c*A is transmitted to the battery output power control panel 63. The battery output power control panel 63 controls an upper limit value of output current of the battery 62 on the basis of the target current upper limit value.

Figure 17:
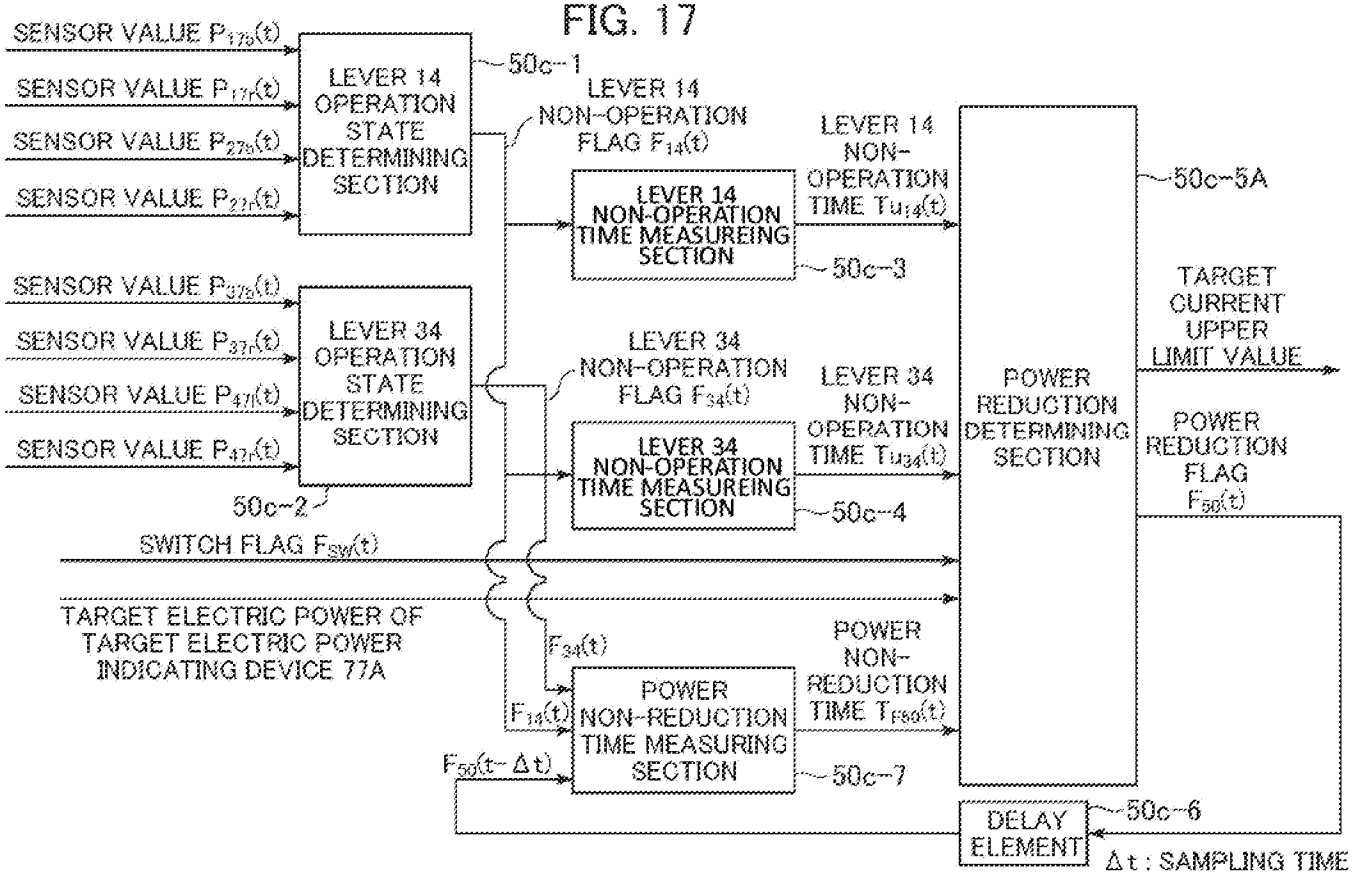
FIG. 17 is a block diagram showing functions of a power computing section in the second embodiment.

Functions of the power computing section 50*c*A in the second embodiment will next be described. FIG. 17 is a block diagram showing functions of the power computing section 50*c*A.

In FIG. 17, the power computing section 50*c*A in the second embodiment is different from that in the first embodiment in that the power computing section 50*c*A includes a power reduction determining section 50*c*-5A in place of the power reduction determining section 50*c*-5, and the power reduction determining section 50*c*-5A outputs the target current upper limit value. Inputs of the power reduction determining section 50*c*-5A are the same as those of the power reduction determining section 50*c*-5 except that the target rotation speed indicating device 77 is replaced with the target electric power indicating device 77A.

Figure 18:
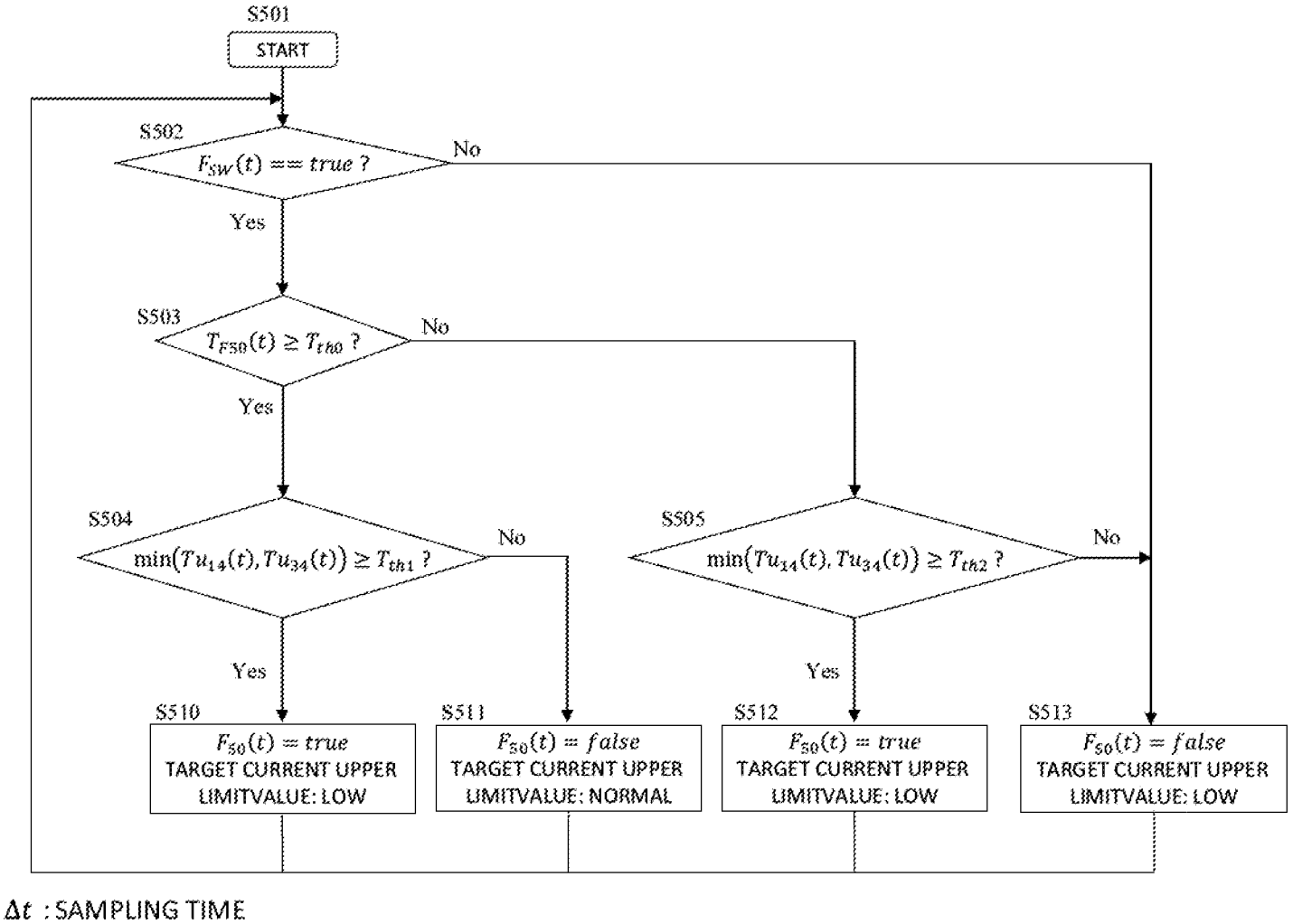
FIG. 18 is a flowchart showing a computation flow of a power reduction determining section in the second embodiment.

A computation flow of the power reduction determining section 50*c*-5A in the second embodiment will next be described. FIG. 18 is a flowchart showing the computation flow of the power reduction determining section 50*c*-5A.

In FIG. 18, the computation flow of the power reduction determining section 50*c*-5A in the second embodiment is different from the computation flow of the power reduction determining section 50*c*-5 in the first embodiment, which is shown in FIG. 13, in that the processing of step S510 is performed in place of step S506, the processing of step S511 is performed in place of step S507, the processing of step S512 is performed in place of step S508, and the processing of step S513 is performed in place of step S509.

In step S510, the power reduction determining section 50*c*-5A sets the power reduction flag F50(*t*) true, and at the same time, the power reduction determining section 50*c*-5A sets a target current upper limit value for control to a target current upper limit value for power reduction control, which is lower than a normal target current upper limit value. The normal target current upper limit value is a value obtained by dividing a target electric power indicated by the target electric power indicating device 77A by a rated voltage of the battery 62. Then, the power reduction determining section 50*c*-5A transmits the target current upper limit value for power reduction control to the battery output power control panel 63. The same processing as in step S510 is performed also in step S512.

In step S511, the power reduction determining section 50*c*-5A sets the power reduction flag F50(*t*) false, and at the same time, the power reduction determining section 50*c*-5A sets the target current upper limit value for control to the normal target current upper limit value calculated from the target electric power indicated by the target electric power indicating device 77A. Then, the power reduction determining section 50*c*-5A transmits the normal target current upper limit value to the battery output power control panel 63. The same processing as in step S511 is performed also in step S513.

The second embodiment configured as described above, in which the power source is constituted by the battery 62 (electric power supply device), the electric motor 60A, and the hydraulic pump 1, provides effects similar to those of the first embodiment. Specifically, it is possible to perform power reduction control during non-operation of the control levers and make a smooth transition to an operation desired to be performed at a time of a return to a normal power state, and suppress electric power consumption of the electric motor 60A and thus reduce an amount of electric power consumed by the electric motor 60A (energy consumption) when the control lever(s) 14 and/or 34 is moved by an erroneous operation.

Third Embodiment

A third embodiment of the present invention will be described with reference to FIGS. 19 to 27. A power reduction in the present embodiment is performed by lowering the voltage of a driving system.

Figure 19:
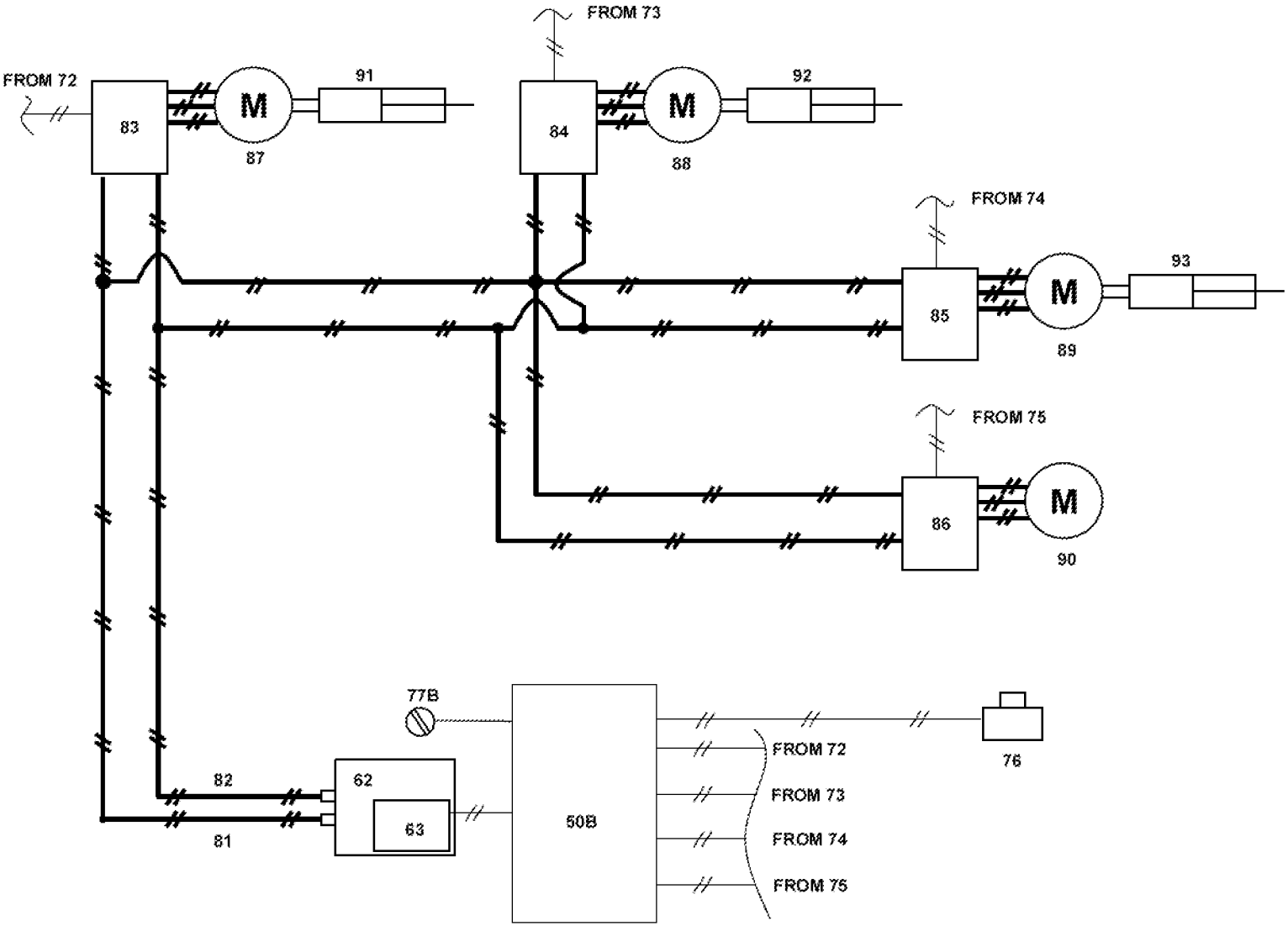
FIG. 19 is a diagram showing a configuration of a driving system in a third embodiment.

A configuration of a driving system in the third embodiment will first be described. FIG. 19 is a diagram showing a configuration of a driving system in the present embodiment.

Figure 20:
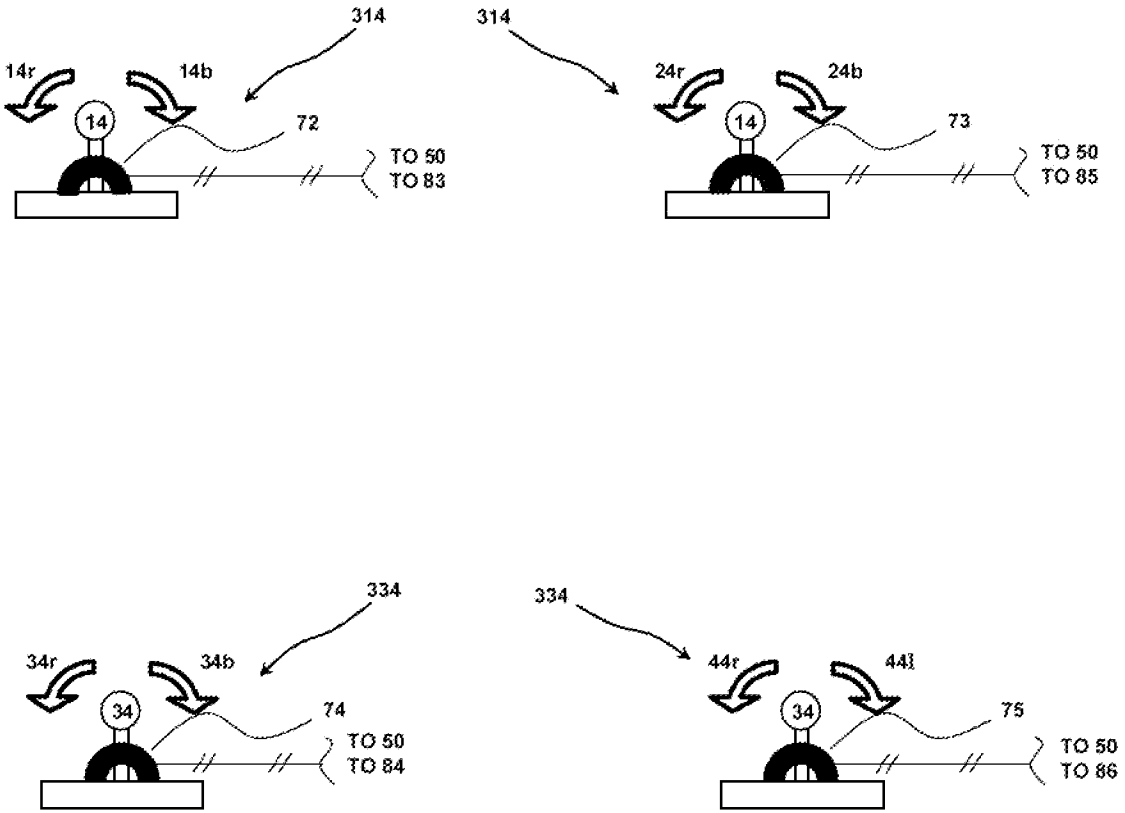
FIG. 20 is a diagram showing a configuration of an operating system of a driving system in the third embodiment.

In FIG. 19, a controller 50B is electrically connected to an angle sensor 72, an angle sensor 73, an angle sensor 74, and an angle sensor 75 shown in FIG. 20, a switch 76, and a target voltage indicating device 77B. The controller 50B receives signals of angle information, switch information, and target voltage information from these angle sensors 72 to 75, the switch 76, and the target voltage indicating device 77B. The controller 50B computes a target voltage for control as an output power target value for a battery 62 on the basis of these signals, and transmits the target voltage to a battery output power control panel 63 electrically connected to the controller 50B. The battery output power control panel 63 controls the voltage of the battery 62 so as to achieve the target voltage.

The battery 62 is connected to a positive electrode side wire 81 and a negative electrode side wire 82. Inverters 83, 84, 85, and 86 are connected in parallel to the positive electrode side wire 81 and the negative electrode side wire 82.

The inverter 83 drives an electric motor 87. The electric motor 87 further drives a cylinder 91 (boom cylinder). The cylinder 91 performs expansion and contraction by converting a rotary motion of the electric motor 87 into a rectilinear motion by a rack-and-pinion mechanism or the like. The inverter 83 receives a signal transmitted from the angle sensor 72, and controls the electric motor 87 so as to achieve a rotation speed corresponding to the information of the signal.

The inverter 84 drives an electric motor 88. The electric motor 88 further drives a cylinder 92 (arm cylinder). The cylinder 92 performs expansion and contraction by converting a rotary motion of the electric motor 88 into a rectilinear motion by a rack-and-pinion mechanism or the like. The inverter 84 receives a signal transmitted from the angle sensor 73, and controls the electric motor 88 so as to achieve a rotation speed corresponding to the information of the signal.

The inverter 85 drives an electric motor 89. The electric motor 89 further drives a cylinder 93 (bucket cylinder). The cylinder 93 performs expansion and contraction by converting a rotary motion of the electric motor 89 into a rectilinear motion by a rack-and-pinion mechanism or the like. The inverter 85 receives a signal transmitted from the angle sensor 74, and controls the electric motor 89 so as to achieve a rotation speed corresponding to the information of the signal.

The inverter 86 drives an electric motor 90 (swing motor). The inverter 86 receives a signal transmitted from the angle sensor 75, and controls the electric motor 90 so as to achieve a rotation speed corresponding to the information of the signal.

Here, the battery 62 is an electric power supply device, and this electric power supply device constitutes a power source. In addition, the electric motor 87 and the cylinder 91, the electric motor 88 and the cylinder 92, the electric motor 89 and the cylinder 93, and the electric motor 90 are each an electric actuator, and constitute a plurality of actuators that are actuated by receiving power from the power source. The inverters 83, 84, 85, and 86 constitute a power distributing device that distributes the power to the plurality of actuators (the electric motor 87 and the cylinder 91, the electric motor 88 and the cylinder 92, the electric motor 89 and the cylinder 93, and the electric motor 90).

Configurations of control lever devices in the third embodiment will next be described with reference to FIG. 20 and FIG. 21.

FIG. 20 is a diagram showing configurations of control lever devices of the driving system in the third embodiment.

In FIG. 20, the control lever devices in the third embodiment are different from the control lever devices in the first embodiment, which are shown in FIG. 4, in that the control lever devices in the third embodiment include a control lever device 314 in place of the control lever device 114, and include a control lever device 334 in place of the control lever device 134. The control lever devices 314 and 334 are of an electric lever type. The control lever device 314 includes a lever 14, an angle sensor 72 that detects angles in the forward direction 14*b* and the rearward direction 14*r* of the lever 14, and an angle sensor 73 that detects angles in the left direction 24*b* and the right direction 24*r* of the lever 14. The control lever device 334 includes a lever 34, an angle sensor 74 that detects angles in the right direction 34*b* and the left direction 34*r* of the lever 34, and an angle sensor 75 that detects angles in the forward direction 44*l* and the rearward direction 44*r* of the lever 34.

The angle sensors 72, 73, 74, and 75 constitute a plurality of operation state sensors that detect the operation states of the control lever devices 314 and 334.

The angle sensors 72, 73, 74, and 75 are electrically connected to the controller 50B, and transmit angle information to the controller 50B.

In addition, the angle sensor 72 is electrically connected to the inverter 83, the angle sensor 73 is electrically connected to the inverter 85, the angle sensor 74 is electrically connected to the inverter 84, and the angle sensor 75 is electrically connected to the inverter 86. The angle sensors 72, 73, 74, and 75 transmit the angle information to the inverters 83, 85, 84, and 86, respectively.

Figure 21:
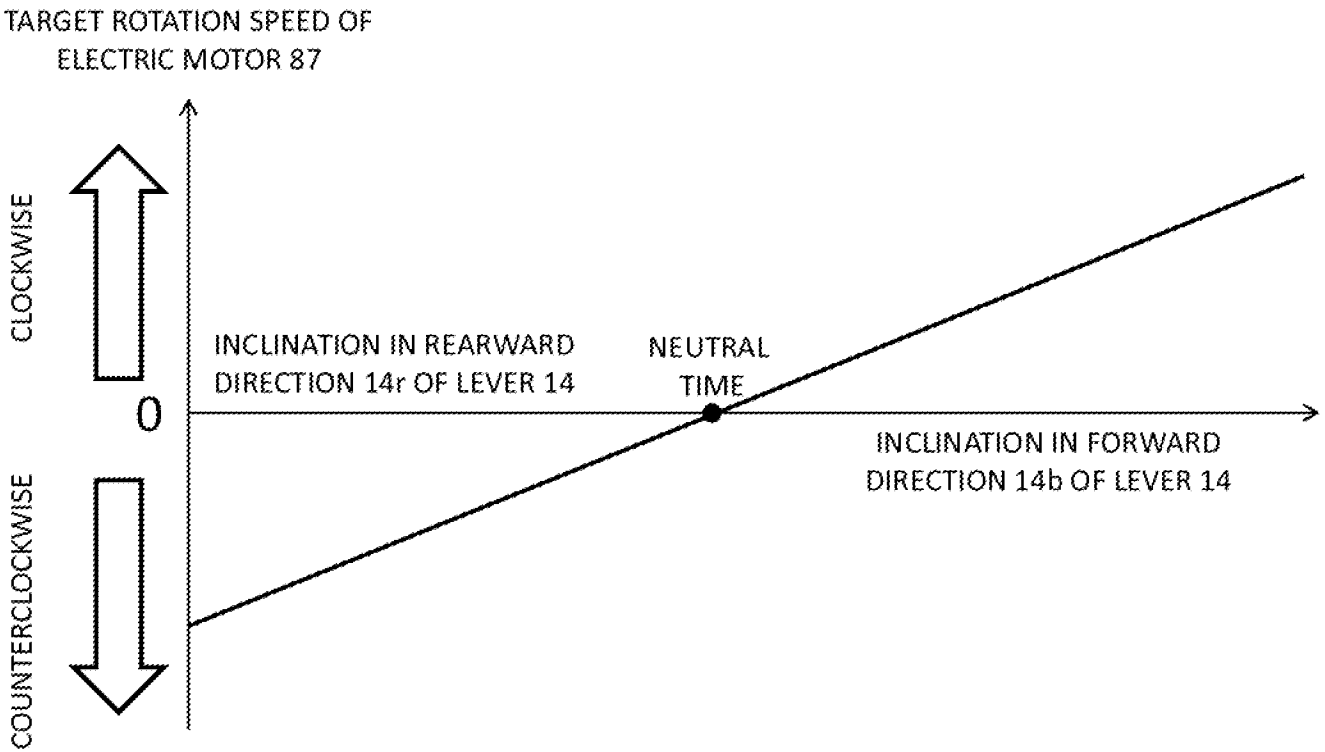
FIG. 21 is a diagram showing relation between an inclination in forward and rearward directions of a lever and the target rotation speed of an electric motor in the third embodiment.

FIG. 21 is a diagram showing relation between inclinations (angles) in the forward and rearward directions 14*b* and 14*r* of the lever 14 and the target rotation speed of the electric motor 87. As shown in FIG. 21, as the lever 14 is inclined in the forward direction 14*b*, the target rotation speed of the electric motor 87 is increased in a clockwise direction. In addition, the target rotation speed of the electric motor 87 is zero at a time of non-operation. As the lever 14 is inclined in the rearward direction 14*r*, the target rotation speed of the electric motor 87 is increased in a counterclockwise direction.

Also when the lever 14 is inclined in the right direction 24*r* or the left direction 24*b*, and the lever 34 is inclined in the right direction 34*b* or the left direction 34*r* and in the forward direction 44*l* or the rearward direction 44*r*, the target rotation speeds of the electric motors 88, 89, and 90 similarly change.

The control lever devices 314 and 334 instruct amounts of power to be distributed to the plurality of actuators (the electric motor 88 and the cylinder 92, the electric motor 89 and the cylinder 93, and the electric motor 90) to the power distributing device (inverters 83, 84, 85, and 86) on the basis of the angle information detected by the angle sensors 72, 73, 74, and 75 as described above.

Figure 22:
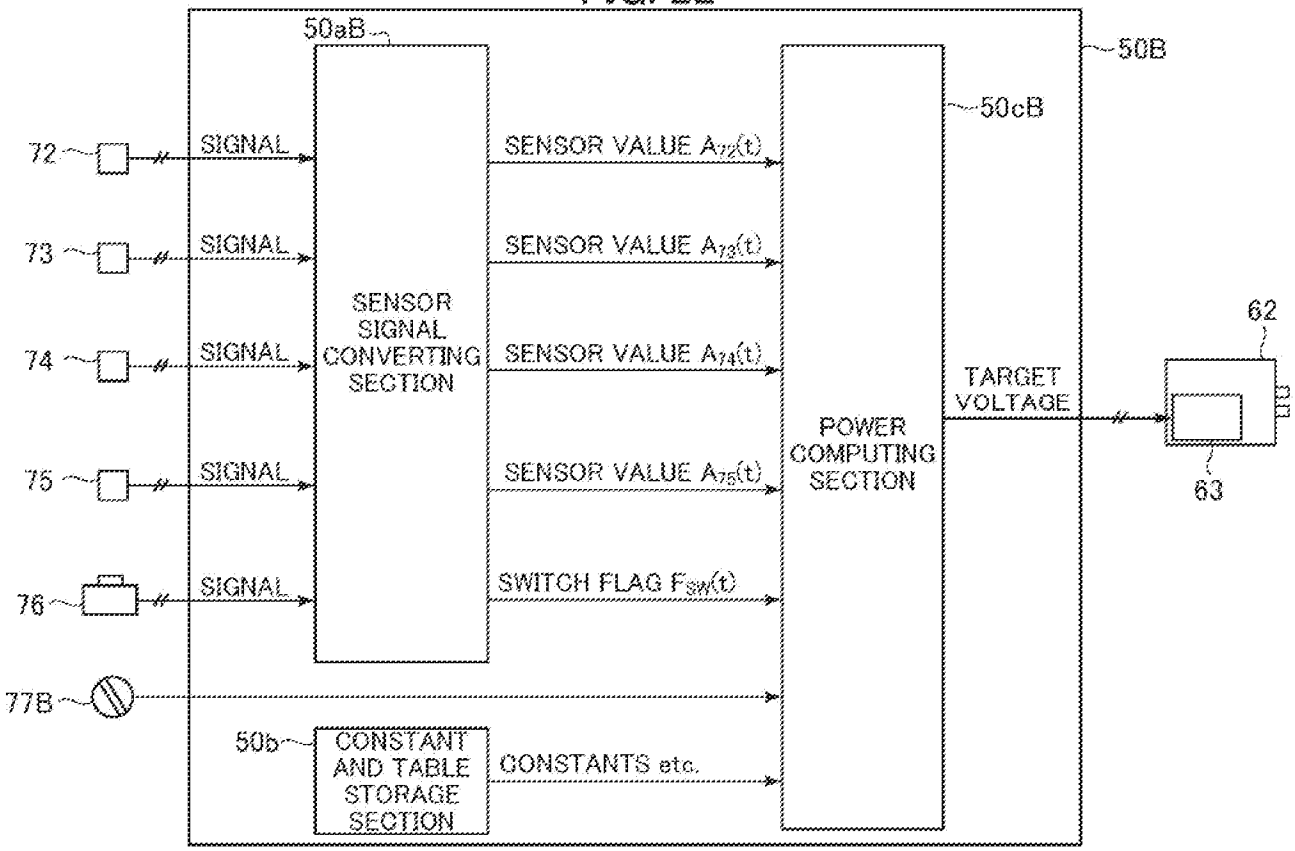
FIG. 22 is a block diagram showing functions of a controller in the third embodiment.

Functions of the controller 50B in the third embodiment will next be described. FIG. 22 is a block diagram showing functions of the controller 50B.

In FIG. 22, the controller 50B in the third embodiment is different from that in the second embodiment in that the controller 50B in the third embodiment includes a sensor signal converting section 50*a*B in place of the sensor signal converting section 50*a*, and includes a power computing section 50*c*B in place of the power computing section 50*c*A.

The sensor signal converting section 50*a*B receives signals sent from the angle sensors 72 to 75 and the switch 76, and converts the signals into angle information and switch flag information. The sensor signal converting section 50*a*B transmits the converted angle information and the converted switch flag information to the power computing section 50*c*B.

The constant and table storage section 50*b* stores constants and tables necessary for calculation. The constant and table storage section 50*b* transmits the constants and the tables to the power computing section 50*c*B.

The power computing section 50*c*B receives the angle information and the switch flag information transmitted from the sensor signal converting section 50*a*B, the constant information and the table information transmitted from the constant and table storage section 50*b*, and the target voltage information transmitted from the target voltage indicating device 77B, and computes a target voltage for control of the battery 62. Then, the power computing section 50*c*B outputs a command signal of the target voltage for control to the battery output power control panel 63. The battery output power control panel 63 controls the voltage of the battery 62 on the basis of the value.

Figure 23:
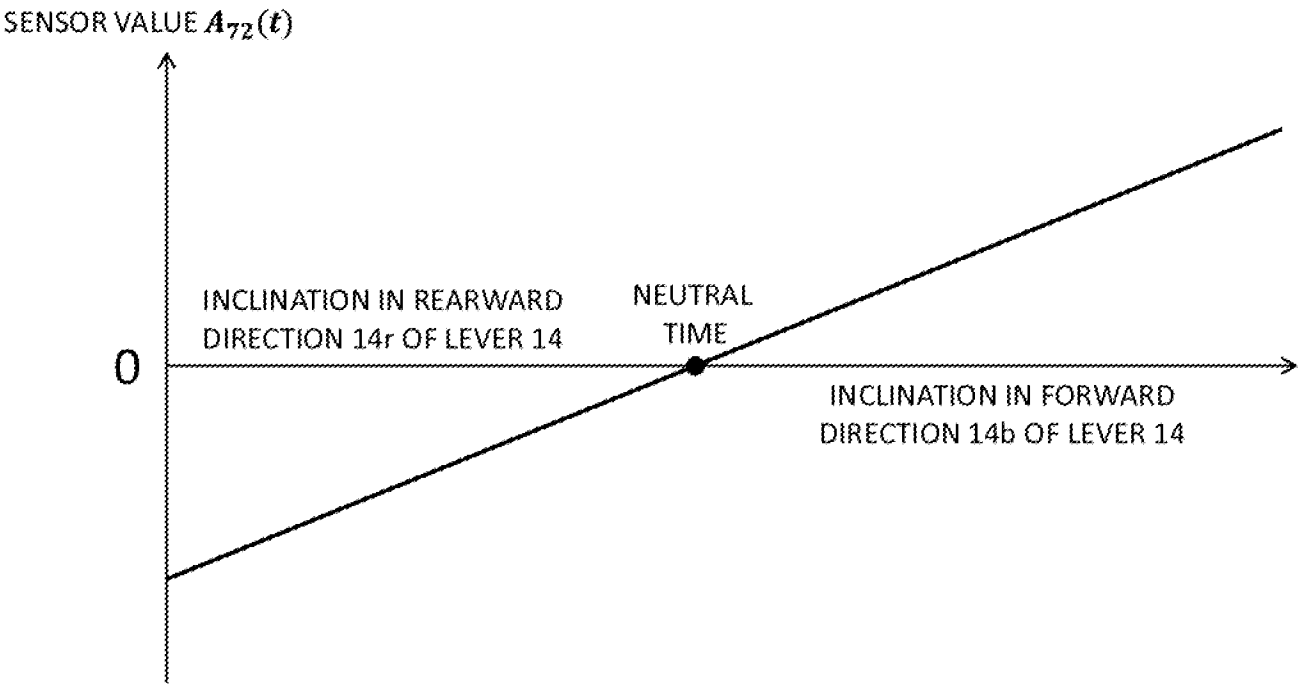
FIG. 23 is a diagram of assistance in explaining conversion processing performed by a sensor signal converting section in the third embodiment.

Sensor signal conversion processing in the sensor signal converting section 50*a*B will next be described. FIG. 23 is a diagram of assistance in explaining the conversion processing performed by the sensor signal converting section 50*a*B when the lever 14 is inclined in the forward direction 14*b* or the rearward direction 14*r*.

As shown in FIG. 23, the sensor signal converting section 50*a*B performs conversion so that a sensor value A72(*t*) is increased as the lever 14 is inclined in the forward direction 14*b*. In addition, the sensor signal converting section 50*a*B performs conversion so that the sensor value A72(*t*) is zero at a time of non-operation. The sensor value A72(*t*) becomes a negative value when the lever 14 is inclined in the rearward direction 14*r*. The same is true when the lever 14 is inclined in the right direction 24*r* or the left direction 24*b*, and when the lever 34 is inclined in the right direction 34*b* or the left direction 34*r* and in the forward direction 44*l* or the rearward direction 44*r*. The sensor value A72(*t*) is a value corresponding to the target rotation speed of the electric motor 87 in FIG. 21.

Figure 24:
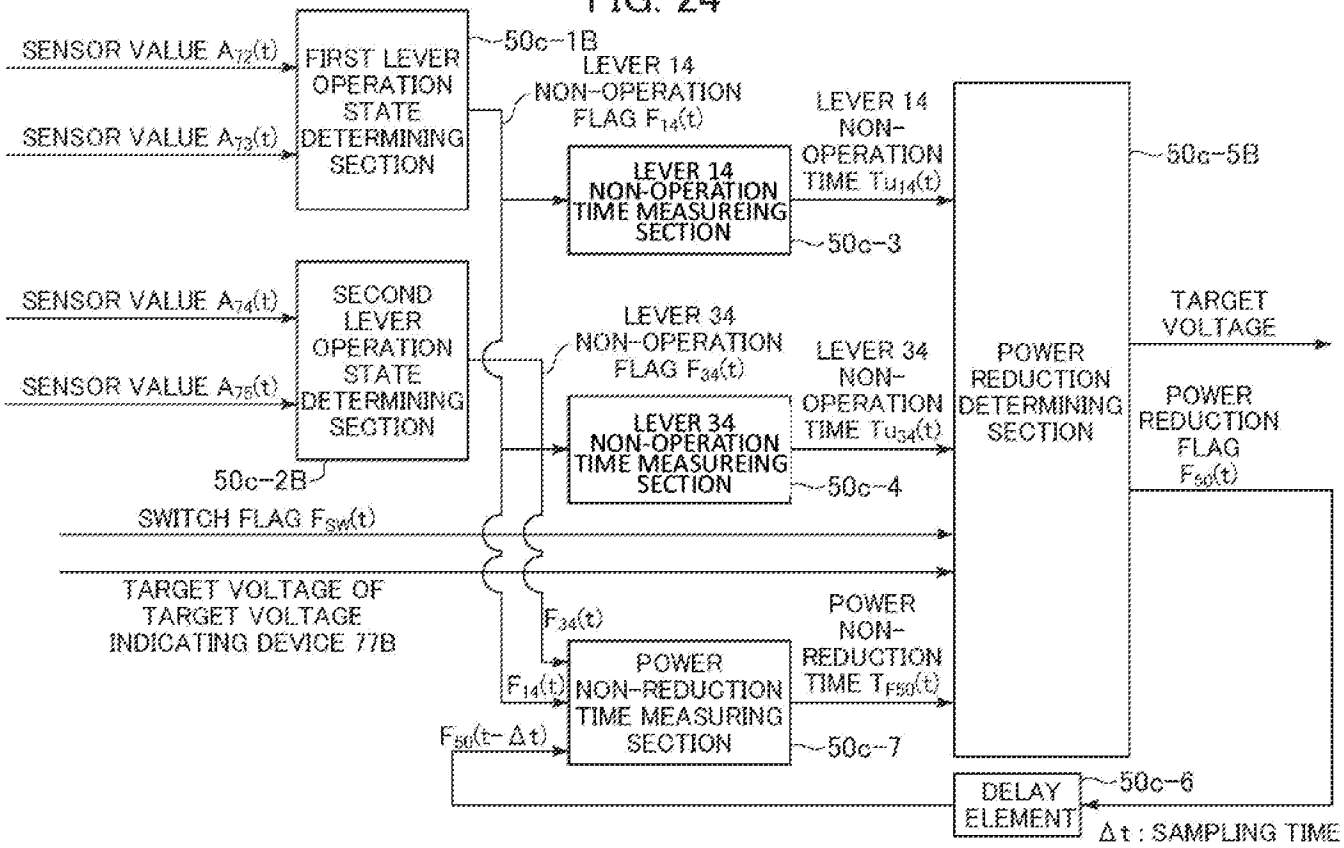
FIG. 24 is a block diagram showing functions of a power computing section in the third embodiment.

Functions of the power computing section 50*c*B in the third embodiment will next be described. FIG. 24 is a block diagram showing functions of the power computing section 50*c*B. Suppose that the sampling time of the controller 50B is Δt.

In FIG. 24, the power computing section 50*c*B in the third embodiment is different from that in the second embodiment in that the power computing section 50*c*B in the third embodiment includes a lever 14 operation state determining section 50*c*-1B in place of the lever 14 operation state determining section 50*c*-1, includes a lever 34 operation state determining section 50*c*-2B in place of the lever 34 operation state determining section 50*c*-2, and includes a power reduction determining section 50*c*-5B in place of the power reduction determining section 50*c*-5A.

Figure 25:
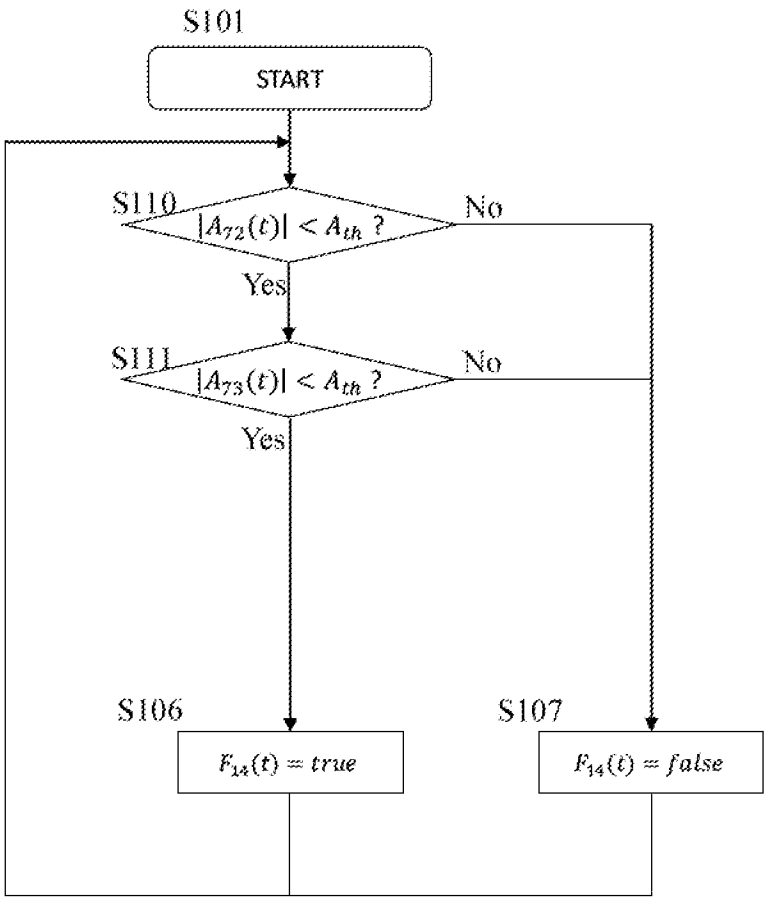
FIG. 25 is a flowchart showing a computation flow of a first lever operation state determining section in the third embodiment.

Functions of the lever 14 operation state determining section 50*c*-1B in the third embodiment will next be described. FIG. 25 is a flowchart showing a computation flow of the lever 14 operation state determining section 50*c*-1B. This computation flow is processed repeatedly in each sampling time Δt while the controller 50B operates, for example.

The computation flow of the lever 14 operation state determining section 50*c*-1B is different from the computation flow of the lever 14 operation state determining section 50*c*-1 in the first embodiment, which is shown in FIG. 7, in that the processing from step S102 to step S105 is eliminated, and the computation flow of the lever 14 operation state determining section 50*c*-1B proceeds from step S101 to the processing of step S110 and step S111.

In step S110, the lever 14 operation state determining section 50*c*-1B determines whether the absolute value of the sensor value A72(*t*) is smaller than a threshold value Ath. When the absolute value of the sensor value A72(*t*) is smaller than the threshold value Ath, the lever 14 operation state determining section 50*c*-1B determines Yes, and proceeds to the processing of step S111. When the absolute value of the sensor value A72(*t*) is equal to or larger than the threshold value Ath, the lever 14 operation state determining section 50*c*-1B determines No, and proceeds to the processing of step S107.

In step S111, the lever 14 operation state determining section 50*c*-1B determines whether the absolute value of a sensor value A73(*t*) is smaller than the threshold value Ath. When the absolute value of the sensor value A73(*t*) is smaller than the threshold value Ath, the lever 14 operation state determining section 50*c*-1B determines Yes, and proceeds to the processing of step S106. When the absolute value of the sensor value A73(*t*) is equal to or larger than the threshold value Ath, the lever 14 operation state determining section 50*c*-1B determines No, and proceeds to the processing of step S107.

In step S106, the lever 14 operation state determining section 50*c*-1B sets the lever 14 non-operation flag F14(*t*) true. In step S107, the lever 14 operation state determining section 50*c*-1B sets the lever 14 non-operation flag F14(*t*) false. These pieces of flag information are transmitted to the lever 14 non-operation time measuring section 50*c*-3 and the power non-reduction time measuring section 50*c*-7.

Figure 26:
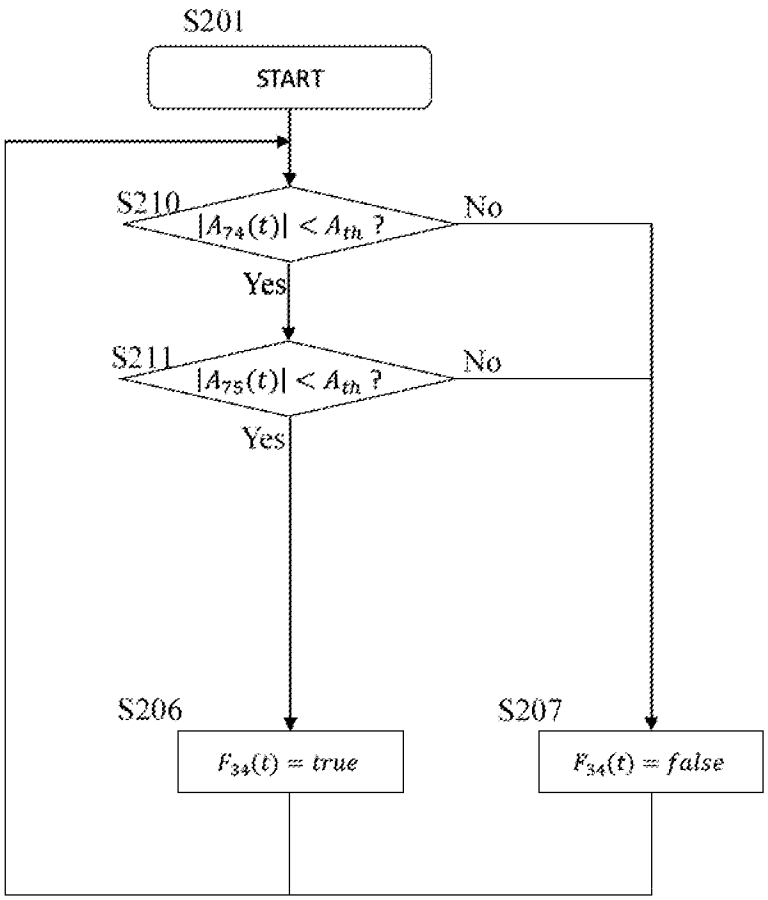
FIG. 26 is a flowchart showing a computation flow of a second lever operation state determining section in the third embodiment.

Functions of the lever 34 operation state determining section 50*c*-2B in the third embodiment will next be described. FIG. 26 is a flowchart showing a computation flow of the lever 34 operation state determining section 50*c*-2B. This computation flow is processed repeatedly in each sampling time Δt while the controller 50B operates, for example.

The computation flow of the lever 34 operation state determining section 50*c*-2B is different from the computation flow of the lever 34 operation state determining section 50*c*-2 in the first embodiment, which is shown in FIG. 8, in that the processing from step S202 to step S205 is eliminated, and the computation flow of the lever 34 operation state determining section 50*c*-2B proceeds from step S201 to the processing of step S210 and step S211.

In step S210, the lever 34 operation state determining section 50*c*-2B determines whether the absolute value of a sensor value A74(*t*) is smaller than the threshold value Ath. When the absolute value of the sensor value A74(*t*) is smaller than the threshold value Ath, the lever 34 operation state determining section 50*c*-2B determines Yes, and proceeds to the processing of step S211. When the absolute value of the sensor value A74(*t*) is equal to or larger than the threshold value Ath, the lever 34 operation state determining section 50*c*-2B determines No, and proceeds to the processing of step S207.

In step S211, the lever 34 operation state determining section 50*c*-2B determines whether the absolute value of a sensor value A75(*t*) is smaller than the threshold value Ath. When the absolute value of the sensor value A75(*t*) is smaller than the threshold value Ath, the lever 34 operation state determining section 50*c*-2B determines Yes, and proceeds to the processing of step S206. When the absolute value of the sensor value A75(*t*) is equal to or larger than the threshold value Ath, the lever 34 operation state determining section 50*c*-2B determines No, and proceeds to the processing of step S207.

In step S206, the lever 34 operation state determining section 50*c*-2B sets the lever 34 non-operation flag F34(*t*) true. In step S207, the lever 34 operation state determining section 50*c*-2B sets the lever 34 non-operation flag F34(*t*) false. These pieces of flag information are transmitted to the lever 34 non-operation time measuring section 50*c*-4 and the power non-reduction time measuring section 50*c*-7.

Thus, the lever 14 operation state determining section 50*c*-1B determines whether the lever 14 is operated from the sensor value A72(*t*) and the sensor value A73(*t*), and outputs the lever 14 non-operation flag F14(*t*). The lever 34 operation state determining section 50*c*-2B determines whether the lever 34 is operated from the sensor value A74(*t*) and the sensor value A75(*t*), and outputs the lever 34 non-operation flag F34(*t*).

The lever 14 non-operation time measuring section 50*c*-3 measures a lever 14 non-operation time Tu14 (*t*) and the time information is transmitted to the power reduction determining section 50*c*-5B. The lever 34 non-operation time measuring section 50*c*-4 measures a lever 34 non-operation time Tu34(*t*) and the time information is transmitted to the power reduction determining section 50*c*-5B.

Figure 27:
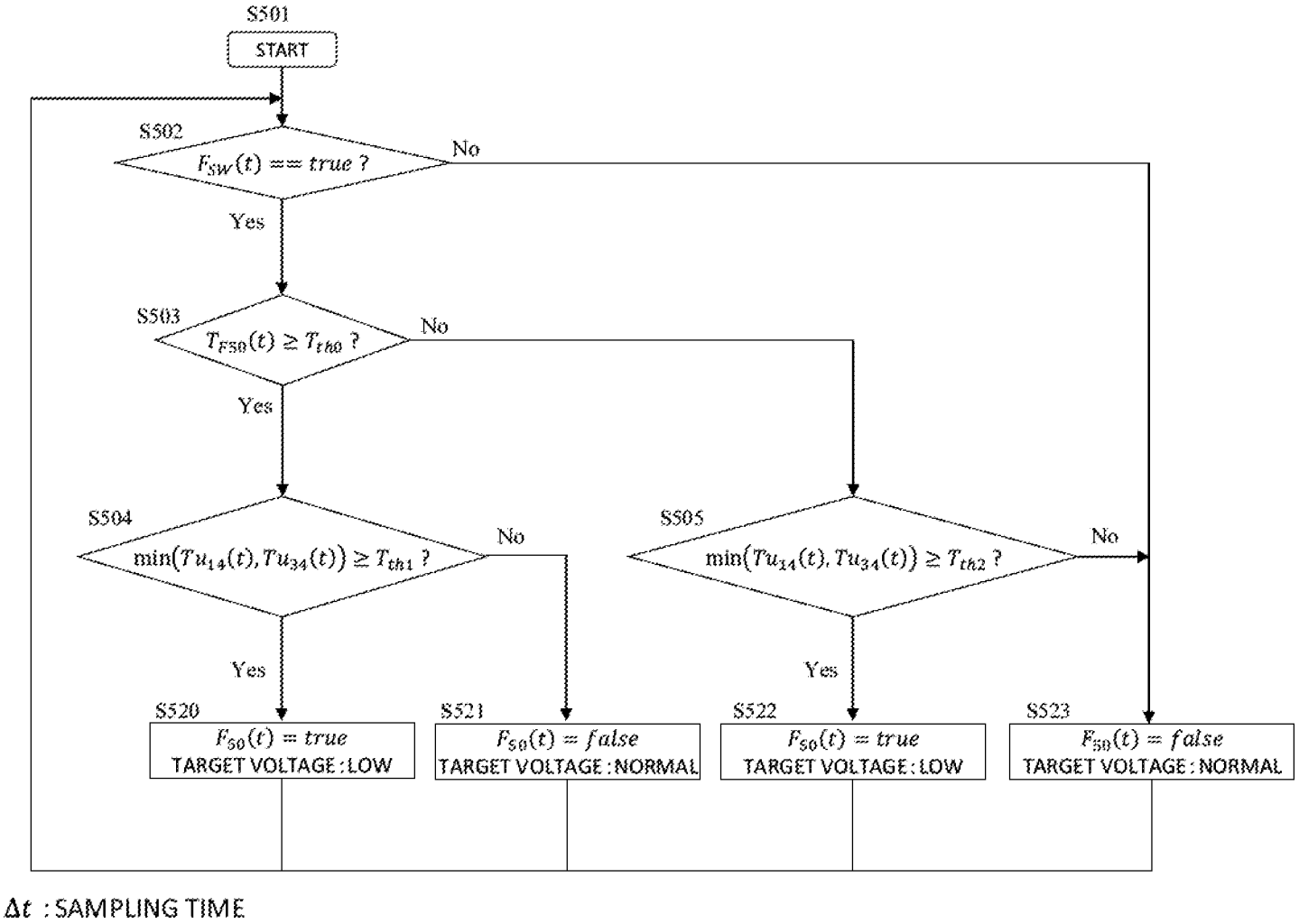
FIG. 27 is a flowchart showing a computation flow of a power reduction determining section in the third embodiment.

A computation flow of the power reduction determining section 50*c*-5B in the third embodiment will next be described. FIG. 27 is a flowchart showing the computation flow of the power reduction determining section 50*c*-5B.

In FIG. 27, the computation flow of the power reduction determining section 50*c*-5B in the third embodiment is different from the computation flow of the power reduction determining section 50*c*-5A in the second embodiment, which is shown in FIG. 18, in that the processing of step S520 is performed in place of step S510, the processing of step S521 is performed in place of step S511, the processing of step S522 is performed in place of step S512, and the processing of step S523 is performed in place of step S513.

In step S520, the power reduction determining section 50*c*-5B sets the power reduction flag F50(*t*) true, and at the same time, the power reduction determining section 50*c*-5B sets the target voltage for control to a target voltage for power reduction control, which is lower than a normal target voltage. The target voltage is a target voltage indicated by the target voltage indicating device 77B. Then, the power reduction determining section 50*c*-5B transmits the target voltage for power reduction control to the battery output power control panel 63. The same processing as in step S520 is performed also in step S522.

In step S521, the power reduction determining section 50*c*-5B sets the power reduction flag F50(*t*) false, and at the same time, the power reduction determining section 50*c*-5B sets the target voltage for control to the normal target voltage indicated by the target voltage indicating device 77B. Then, the power reduction determining section 50*c*-5B transmits the normal target voltage to the battery output power control panel 63. The same processing as in step S521 is performed also in step S523.

The third embodiment configured as described above, in which the power source is constituted by the battery 62 (electric power supply device) and the actuators are constituted by electric actuators including the electric motors 87 to 90, provides effects similar to those of the first embodiment. Specifically, it is possible to perform power reduction control during non-operation of the control levers and make a smooth transition to an operation desired to be performed at a time of a return to a normal power state, and reduce electric power consumption of the battery 62 and thus reduce an amount of electric power consumed by the battery 62 (energy consumption) when the control lever(s) 14 and/or 34 is moved by an erroneous operation.

<First Modification>

In the first embodiment, description has been made of a case where the control lever devices 114 and 134 are of a hydraulic pilot type including pilot valves, and the operation state sensors are the pressure sensors 17*b*, 17*r*, 27*b*, 27*r*, 37*b*, 37*r*, 47*l*, and 47*r* that detect the operation pressures generated by the pilot valves. However, the operation states sensors may be of other configurations.

For example, the operation states of the control lever devices may be detected by providing one or a plurality of signal pressure generating lines that introduce the delivery oil of the pilot pump 51 shown in FIG. 2 to the tank 5, arranging a plurality of signal pressure generating valves on the one or plurality of signal pressure generating lines, switching the signal pressure generating valves by the operation pressures generated by the pilot valves, and detecting the pressure of the signal pressure generating line(s), which is changed by opening or closing the signal pressure generating valves.

Figure 28:
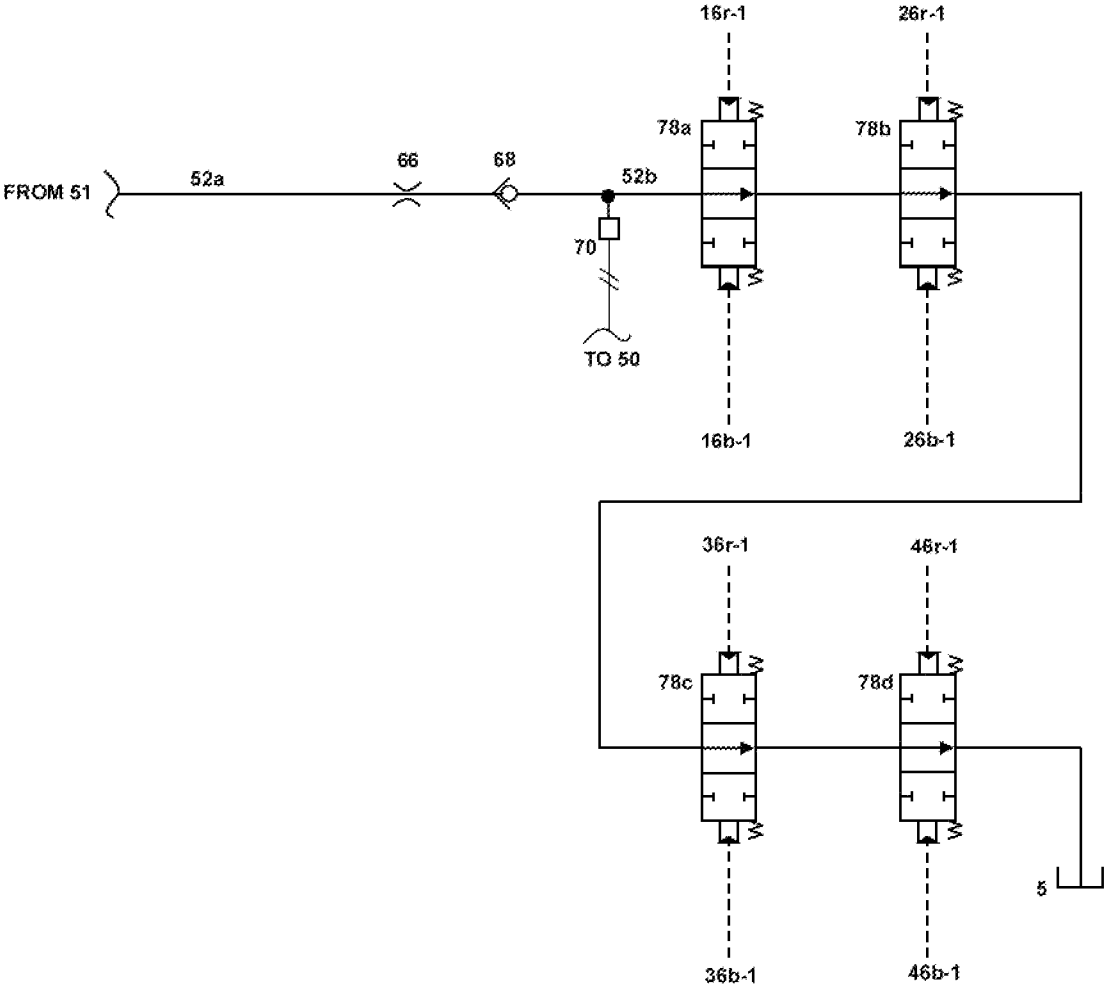
FIG. 28 is a diagram showing an operation state sensor provided with signal pressure generating valves in a modification of the first embodiment.

FIG. 28 is a diagram showing an example of an operation state sensor provided with such signal pressure generating valves.

In FIG. 28, reference numeral 52*a* denotes a pilot line branched from the pilot line 52 (see FIG. 2 and FIG. 4) connected to the pilot pump 51. A signal pressure generating line 52*b* is connected to the pilot line 52*a* via a restricting section 66 and a check valve 68. The downstream of the signal pressure generating line 52*b* is connected to the tank 5. Normally open signal pressure generating valves 78*a*, 78*b*, 78*c*, and 78*d* are connected in series with each other on the signal pressure generating line 52*b*. A pressure sensor 70 is connected upstream of the signal pressure generating valves 78*a*, 78*b*, 78*c*, and 78*d* of the signal pressure generating line 52*b*.

The signal pressure generating valve 78*a* can be switched by operation pressure generated in the lines 16*b* and 16*r* shown in FIG. 4 and introduced to lines 16*b*-1 and 16*r*-1. When the lever 14 is operated and thereby an operation pressure is generated in one of the lines 16*b* and 16*r*, the signal pressure generating valve 78*a* is closed, and a signal pressure is generated in the signal pressure generating line 52*b*. The pressure sensor 70 measures the pressure, and transmits a signal to the controller 50.

The same is true for the signal pressure generating valves 78*b*, 78*c*, and 78*d*. When the lever 14 shown in FIG. 4 is operated, and thereby an operation pressure is generated in one of the lines 26*b* and 26*r*, the lines 36*b* and 36*r*, and the lines 46*b* and 46*r*, the signal pressure generating valve 78*b*, 78*c*, or 78*d* is closed, and a signal pressure is generated in the signal pressure generating line 52*b*. The pressure sensor 70 measures the pressure, and transmits a signal to the controller 50.

The controller 50 determines whether at least one of the lever 14 and the lever 34 is operated on the basis of the signals transmitted from the pressure sensor 70.

Figure 29:
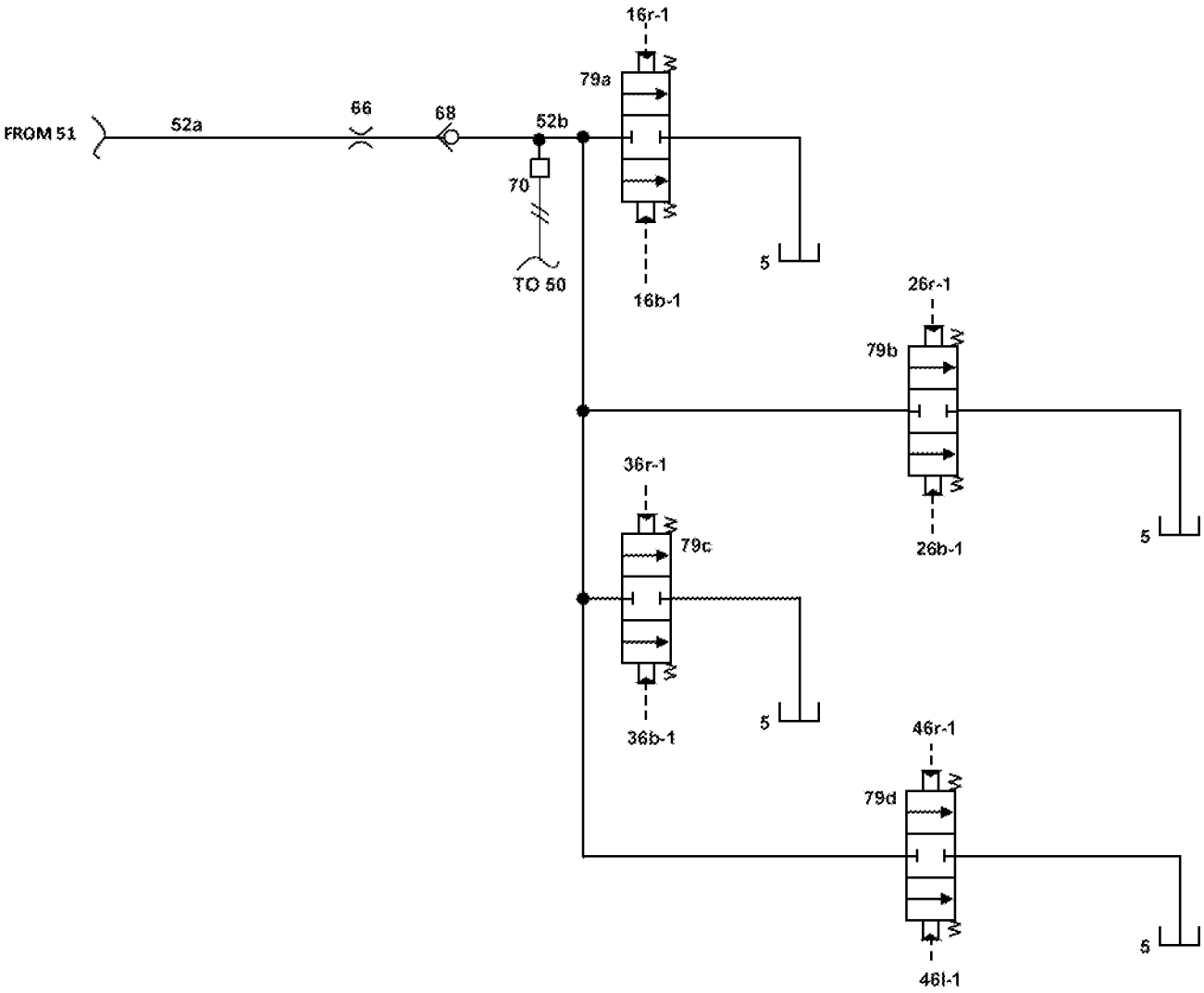
FIG. 29 is a diagram showing an operation state sensor provided with signal pressure generating valves in another modification of the first embodiment.

FIG. 29 is a diagram showing another example of an operation state sensor provided with signal pressure generating valves.

In FIG. 29, normally closed signal pressure generating valves 79*a*, 79*b*, 79*c*, and 79*d* are connected in parallel to the signal pressure generating line 52*b* downstream of the check valve 68, and the downstreams of the signal pressure generating valves 79*a*, 79*b*, 79*c*, and 79*d* are each connected to the tank 5.

When the lever 14 is operated and thereby an operation pressure is generated in one of the lines 16*b* and 16*r*, and the operation pressure is introduced to one of the lines 16*b*-1 and 16*r*-1, the signal pressure generating valve 79*a* is opened, and the signal pressure generating line 52*b* is set to a tank pressure. The pressure sensor 70 measures the pressure as a signal pressure, and transmits a signal to the controller 50.

The same is true for the signal pressure generating valves 79*b*, 79*c*, and 79*d*. When the lever 14 is operated and thereby an operation pressure is generated in one of the lines 26*b* and 26*r*, the lines 36*b* and 36*r*, and the lines 46*b* and 46*r*, the signal pressure generating valve 79*b*, 79*c*, or 79*d* is opened, and the signal pressure generating line 52*b* is set at the tank pressure. The pressure sensor 70 measures the pressure as a signal pressure, and transmits a signal to the controller 50.

The controller 50 determines whether at least one of the lever 14 and the lever 34 is operated on the basis of the signals transmitted from the pressure sensor 70.

When the operation state sensor is configured as described above, one pressure sensor 70 suffices, and the configuration of the operation state sensor and the signal processing of the controller 50 can be simplified.

In addition, as another modification of the operation state sensor, even in a case where the control lever devices 114 and 134 are of a hydraulic pilot type as shown in FIG. 4, the operation states of the control lever devices 114 and 134 may be detected by providing the angle sensors 72, 73, 74, and 75 to the control levers 14 and 34 as in the third embodiment shown in FIG. 20, and detecting the angles of the control levers 14 and 34.

<Second Modification>

Figure 30:
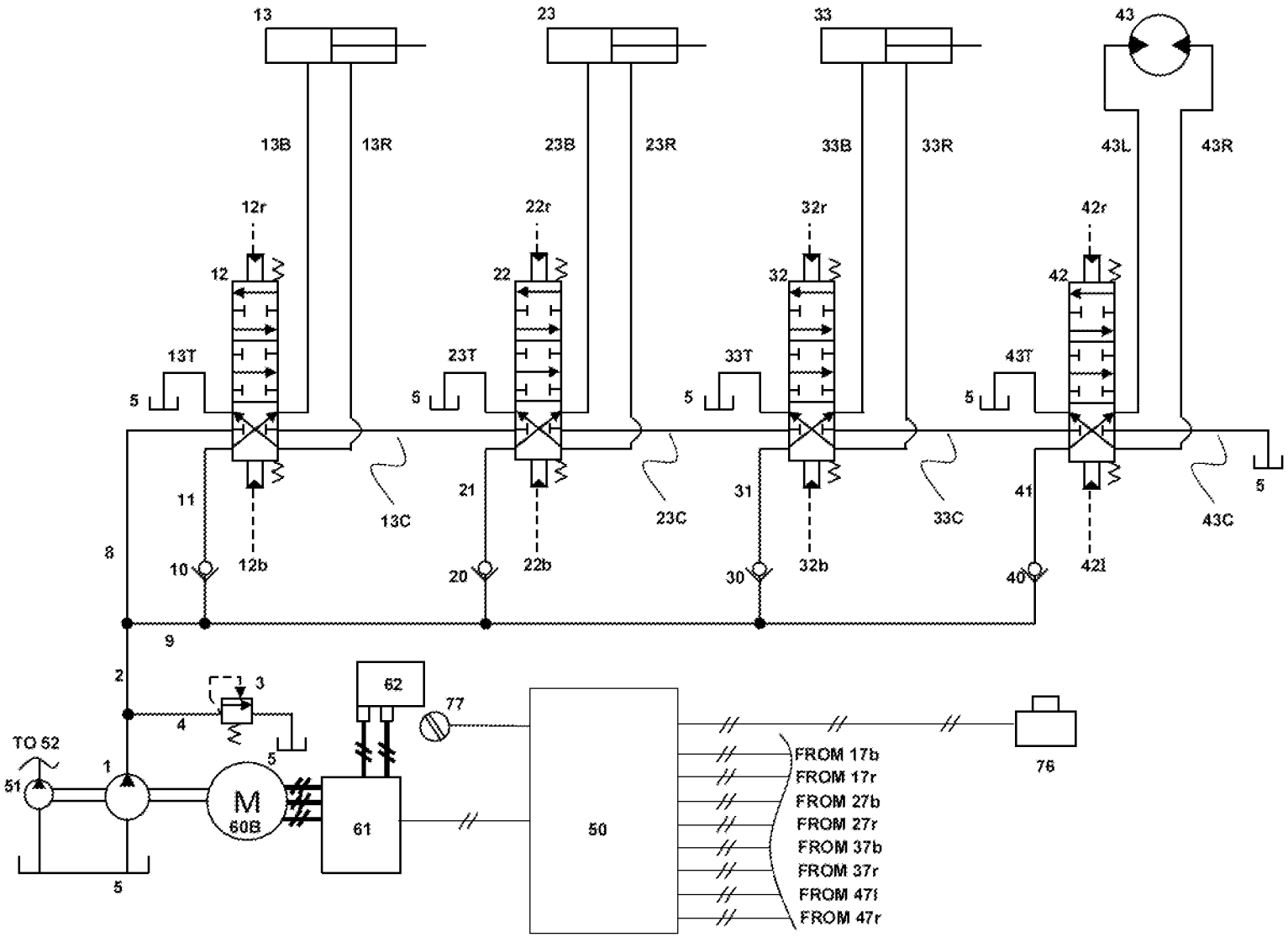
FIG. 30 is a diagram showing a modification of the driving system in the first embodiment.

In the first embodiment, the power source of the driving system has a configuration including the engine 6. In the second embodiment, the power source of the driving system has a configuration including the direct-current electric motor 60A. However, a configuration including an alternating-current electric motor may be adopted in place of the engine 6 or the direct-current electric motor 60A. FIG. 30 is a diagram showing a modification of such a driving system.

A driving system according to the present modification in FIG. 30 is different from that of the first embodiment in that the hydraulic pump 1 is driven by an alternating-current electric motor 60B, the hydraulic pump 1, the alternating-current electric motor 60B, and the battery 62 constitute a power source of the driving system, and the electric motor 60B is controlled by an inverter 61. The inverter 61 is electrically connected to the controller 50.

The controller 50 calculates a target rotation speed for control by performing processing similar to that of the controller 50 shown in FIG. 5. In addition, the inverter 61 is also electrically connected to the battery 62. The inverter 61 converts the direct current of the battery 62 into a three-phase alternating current on the basis of the target rotation speed from the controller 50. The electric motor 60B is driven by the alternating current.

Such a configuration can also provide effects similar to those of the first and second embodiments.

DESCRIPTION OF REFERENCE CHARACTERS

1: Hydraulic pump (power source)
2: Line
3: Relief valve
4: Relief line
5: Tank
6: Engine (power source)
7: Rotation speed controller
8, 9: Line
10, 20, 30, 40: Check valve
11, 21, 31, 41: Line
12, 22, 32, 42: Directional control valve (power distributing device)
12*r*, 12*b*, 22*r*, 22*b*, 32*r*, 32*b*, 42*r*, 42*l*: pilot line
13, 23, 33: Cylinder (actuator)
13B, 23B, 33B: Bottom line
13R, 23R, 33R: Rod line
13T, 23T, 33T, 43T: Tank line
13C, 23C, 33C, 43C: Center bypass line
14: Control lever (first control lever)
15*r*, 15*b*, 25*r*, 25*b*, 35*r*, 35*b*, 45*r*, 45*l*: Pilot valve
16*r*, 16*b*, 26*r*, 26*b*, 36*r*, 36*b*, 46*r*, 46*l*: Line
17*r*, 17*b*, 27*r*, 27*b*, 37*r*, 37*b*, 47*l*, 47*r*: Pressure sensor (operation state sensor)
18, 28, 38, 48: Line
19, 29, 39, 49: Line

34: Control lever (second control lever)
43: Hydraulic motor
43L: Left rotation line
43R: Right rotation line
50, 50A, 50B: Controller
51: Pilot pump
52: Pilot line
53: Relief valve
60A: Electric motor (direct current) (power source)
60B: Electric motor (alternating current) (power source)
61: Inverter
62: Battery (electric power supply device; power source)
63: Battery output power control panel
70: Pressure sensor (operation state sensor)
72, 73, 74, 75: Angle sensor (operation state sensor)
76: Switch
77: Target rotation speed indicating device
77A: Target electric power indicating device
77B: Target voltage indicating device
81: Positive electrode side wire
82: Negative electrode side wire
83, 84, 85, 86: Inverter (power distributing device)
87, 88, 89, 90: Electric motor (actuator)
91, 92, 93: Cylinder (actuator)
94, 95, 96, 97: Restricting section
114, 134: Control lever device
314, 334: Control lever device
Tth0 Monitoring time
Tth1 First set time
Tth2 Second set time

The invention claimed is:

1. A construction machine comprising:

a power source;

a plurality of actuators that operate by receiving a power from the power source;

a plurality of control levers that instruct amounts of the power to be distributed to the plurality of actuators;

a plurality of operation state sensors that detect operation states of the plurality of control levers; and a controller that controls the power output by the power source, the controller being configured to perform power reduction control of the power source on a basis of the operation states of the plurality of control levers detected by the plurality of operation state sensors when a non-operation time of the plurality of control levers exceeds a set time after a transition is made from a state in which at least one of the plurality of control levers is operated to a non-operation state in which none of the plurality of control levers is operated, and to cancel the power reduction control when at least one of the plurality of control levers is operated in a state in which the power reduction control is performed, wherein the controller is further configured to set the set time as a first set time when an operation time until the at least one control lever makes a transition to the non-operation state is longer than a monitoring time set in advance, and set the set time as a second set time shorter than the first set time when the operation time until the at least one control lever makes a transition to the non-operation state is shorter than the monitoring time set in advance.

2. The construction machine according to claim 1, wherein the controller is configured to generate non-operation state information indicating that the plurality of control levers are in the non-operation state and power reduction control state information indicating that the power reduction control is performed on a basis of the operation states of the plurality of control levers detected by the plurality of operation state sensors, and calculate a power non-reduction time during which the power reduction control is not performed on a basis of the non-operation state information and the power reduction control state information, and use the power non-reduction time as the operation time of the at least one control lever.

3. The construction machine according to claim 1, wherein the controller is configure to determine that the operation of the at least one control lever is an erroneous operation when the transition is made from the state in which the at least one control lever is operated to the non-operation state and when the at least one control lever is set in the non-operation state during the monitoring time.

4. The construction machine according to claim 1, comprising: a lower track structure, an upper swing structure swingably mounted on the lower track structure; and a front work implement attached to a front portion of the upper swing structure so as to be rotatable in an upward-downward direction, wherein the plurality of actuators include a swing motor that swing the upper swing structure with respect to the lower track structure, and a first front implement actuator, a second front implement actuator, and a third front implement actuator that drive the front work implement, and the plurality of control levers include a control lever that operates the first front implement actuator and the second front implement actuator, and a control lever that operates the swing motor and the third front implement actuator.

5. The construction machine according to claim 1, wherein the power source includes an engine and a hydraulic pump, the power source generates the power by driving the hydraulic pump by the engine, and the controller is configured to perform the power reduction control by reducing rotation speed of the engine.

6. The construction machine according to claim 1, wherein the power source includes an electric power supply device, an electric motor, and a hydraulic pump, the power source generates the power by driving the electric motor by electric power supply from the electric power supply device, and driving the hydraulic pump by the electric motor, and the controller is configured to perform the power reduction control by reducing electric power supplied to the electric motor, and reducing rotation speed of the electric motor.

7. The construction machine according to claim 1, wherein the power source includes an electric power supply device, the actuators are electric actuators including electric motors, the power source drives the electric actuators by electric power supply from the electric power supply device, and the controller is configured to perform the power reduction control by reducing electric power supplied from the electric power supply device to the electric motors, and reducing rotation speeds of the electric motors.

* * * * *